US010756497B2

(12) United States Patent
Tanaka

(10) Patent No.: US 10,756,497 B2
(45) Date of Patent: Aug. 25, 2020

(54) ELECTRICAL CONNECTOR WITH GRIPPING MEANS ON HOUSING AND ENGAGEMENT MEMBER INSERTED INTO HOUSING

(71) Applicant: Japan Aviation Electronics Industry, Limited, Tokyo (JP)

(72) Inventor: Masashi Tanaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/531,267

(22) Filed: Aug. 5, 2019

(65) Prior Publication Data

US 2020/0161817 A1 May 21, 2020

(30) Foreign Application Priority Data

Nov. 19, 2018 (JP) ..... 2018-216488

(51) Int. Cl.
*H01R 24/64* (2011.01)
*H01R 13/58* (2006.01)
(Continued)

(52) U.S. Cl.
CPC ..... *H01R 24/64* (2013.01); *H01R 13/502* (2013.01); *H01R 13/5825* (2013.01);
(Continued)

(58) Field of Classification Search
CPC ..... H01R 24/64; H01R 2107/00; H01R 13/6461; H01R 24/60; H01R 24/00;
(Continued)

(56) References Cited

U.S. PATENT DOCUMENTS 7,201,604 B1 * 4/2007 Annidon ..... H01R 13/5825 439/418
7,484,993 B2 * 2/2009 Annidon ..... H01R 13/5825 439/418

(Continued)

FOREIGN PATENT DOCUMENTS

JP 3127814 U * 12/2006
JP 3127814 U 12/2006

*Primary Examiner* — Abdullah A Riyami
*Assistant Examiner* — Justin M Kratt
(74) *Attorney, Agent, or Firm* — Collard & Roe, P.C.

(57) ABSTRACT

A connector, to which an end portion of a cable including a plurality of core wires is to be connected, comprises a housing including an arrangement surface section defining an arrangement space in which the cable is arranged through an opening, and an engagement member arranged in the arrangement space to hold the cable in the arrangement space together with the housing. The housing includes a first engagement portion for locking the cable by being displaced upward to project into the arrangement space, thereby pressing an outer surface of the cable arranged in the arrangement space. The engagement member includes a pair of second engagement portions arranged opposite to each other in a left-to-right direction through contact with the arrangement surface section, when the engagement member is arranged in the arrangement space, so as to lock the cable by pressing and sandwiching the outer surface of the cable.

13 Claims, 18 Drawing Sheets

(51) Int. Cl.

| | |
|---|---|
| ***H01R 13/502*** | (2006.01) |
| ***H01R 13/658*** | (2011.01) |
| ***H01R 27/00*** | (2006.01) |
| *H01R 107/00* | (2006.01) |
| *H01R 24/62* | (2011.01) |
| *H01R 12/53* | (2011.01) |
| *H01R 13/453* | (2006.01) |
| *H01R 13/6461* | (2011.01) |
| *H01R 13/506* | (2006.01) |
| *H01R 24/60* | (2011.01) |
| *H01R 13/6463* | (2011.01) |
| *H01R 13/50* | (2006.01) |
| *H01R 4/2433* | (2018.01) |
| *H01R 24/00* | (2011.01) |
| *H01R 13/627* | (2006.01) |
| *H01R 13/26* | (2006.01) |

(52) U.S. Cl.
CPC ..... *H01R 13/658* (2013.01); *H01R 27/00* (2013.01); *H01R 4/2433* (2013.01); *H01R 12/53* (2013.01); *H01R 13/26* (2013.01); *H01R 13/4538* (2013.01); *H01R 13/501* (2013.01); *H01R 13/506* (2013.01); *H01R 13/582* (2013.01); *H01R 13/6273* (2013.01); *H01R 13/6461* (2013.01); *H01R 13/6463* (2013.01); *H01R 24/00* (2013.01); *H01R 24/60* (2013.01); *H01R 24/62* (2013.01); *H01R 2107/00* (2013.01); *H01R 2201/04* (2013.01)

(58) Field of Classification Search
CPC .. H01R 2201/04; H01R 13/582; H01R 12/53; H01R 13/26; H01R 24/62; H01R 4/2433; H01R 13/506; H01R 13/6463; H01R 13/501; H01R 13/6273; H01R 13/4538; H01R 13/502
USPC ..... 439/676, 344, 460, 467, 469
See application file for complete search history.

(56) References Cited

U.S. PATENT DOCUMENTS

2012/0094525 A1* 4/2012 Maranto ..... H01R 13/5825 439/460
2015/0295350 A1* 10/2015 Bragg ..... H01R 13/627 174/541

* cited by examiner

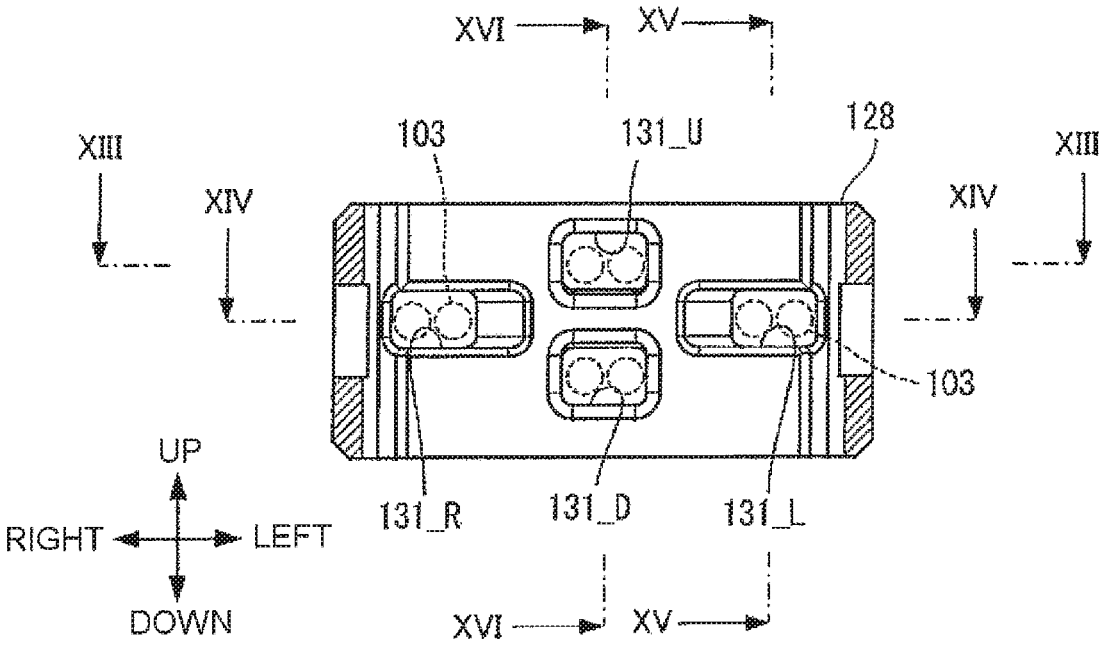
FIG. 12
FIG. 13
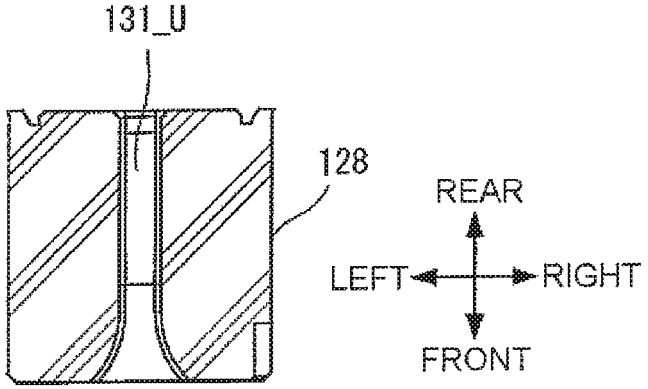
FIG. 14
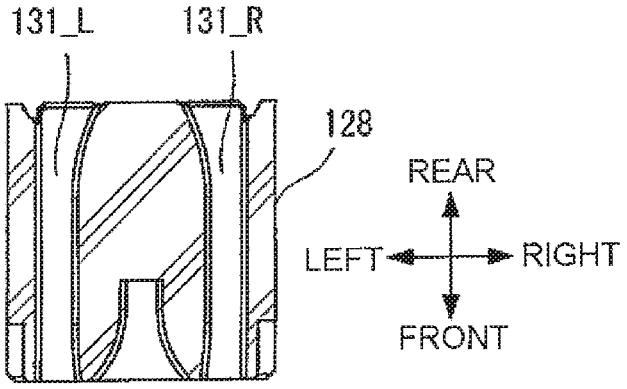

FIG. 15
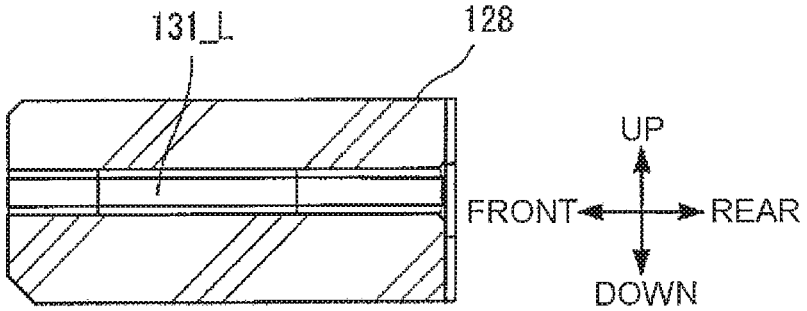
FIG. 16
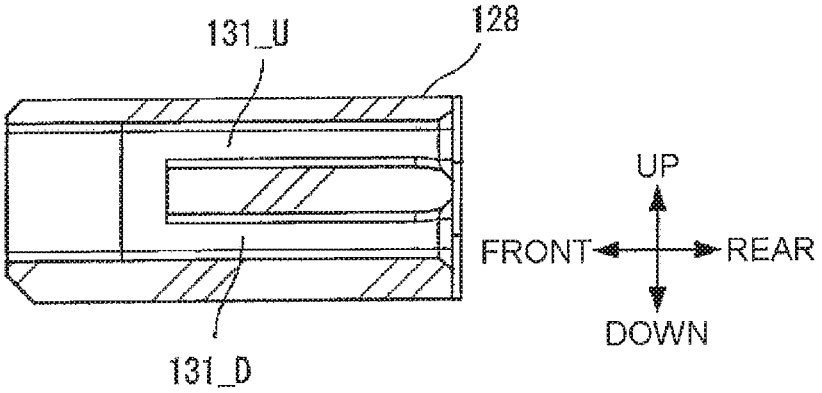
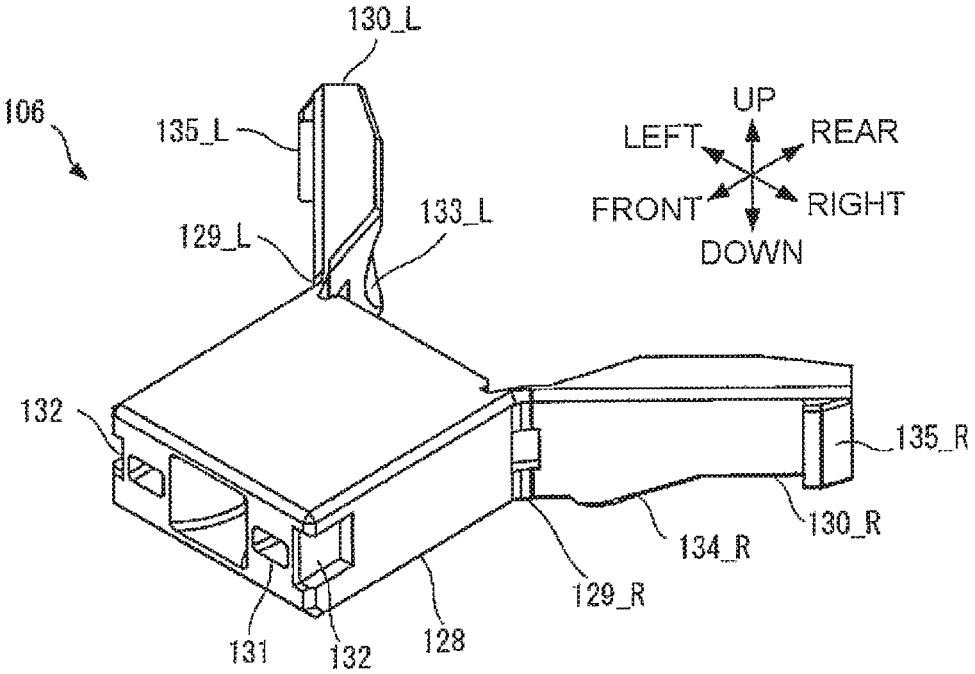
FIG. 17

ELECTRICAL CONNECTOR WITH GRIPPING MEANS ON HOUSING AND ENGAGEMENT MEMBER INSERTED INTO HOUSING

CROSS REFERENCE TO RELATED APPLICATIONS

Applicant claims priority under 35 U.S.C. § 119 of Japanese Application No. 2018-216488 filed on Nov. 19, 2018, the disclosure of which is incorporated by reference.

BACKGROUND OF THE INVENTION

1. Field of the Invention

This invention relates to a connector.

2. Description of the Related Art

For example, in Japanese Utility Model Registration No. 3127814 (JP 3127814 U) (Patent Literature 1), a high-frequency transmission plug including a plug housing 1, a load bar 2, and a cable organizer 3 is disclosed as illustrated in FIG. 35. In the high-frequency transmission plug, a press-holding block 121 in a positioning cell 12, which is located on an upper rear side of the plug housing 1, is pressed downward, and a lower end surface 1210 of a recessed arc portion 1211 of the press-holding block 121 crimps and fixes the plug housing 1 and a rear side of a cable 4 to each other.

However, in the high-frequency transmission plug described in Patent Literature 1, in order to firmly fix the cable 4, typically, it is required to press the cable 4 by a strong force. The cable 4 pressed by the strong force is significantly squeezed. As a result, a gap may be formed between an electric wire of the cable and a sheath of the cable, or damage of the cable such as deformation of the electric wire itself may be caused.

SUMMARY OF THE INVENTION

This invention has been made in view of the above-mentioned circumstances, and has an object to provide a connector capable of firmly fixing a cable while reducing a risk of damaging the cable.

In order to achieve the above-mentioned object, a connector according to this invention a connector to which an end portion of a cable including a plurality of core wires is to be connected, the connector comprising:

a housing including an arrangement surface section defining an arrangement space in which the cable is arranged through an opening, the arrangement space extending in a first direction from an inside of the housing toward the opening; and an engagement member, which is arranged in the arrangement space, and is configured to hold the cable in the arrangement space together with the housing, wherein the housing includes a first engagement portion configured to lock the cable in such a manner that the first engagement portion is displaced in a second direction orthogonal to the first direction so as to project into the arrangement space, and thus presses an outer surface of the cable arranged in the arrangement space, and wherein the engagement member includes a pair of second engagement portions arranged in an opposing manner along a third direction, which is orthogonal to the first direction and intersects the second direction, through contact with the arrangement surface section when the pair of second engagement portions is arranged in the arrangement space, and the pair of second engagement portions is configured to lock the cable by pressing and sandwiching the outer surface of the cable.

The engagement member may further include a core wire holding portion configured to hold the plurality of core wires, and each of the pair of second engagement portions may extend in the first direction from one of end portions of the core wire holding portion along the first direction.

The engagement member may further include a coupling portion configured to couple the core wire holding portion and each of the pair of second engagement portions to each other, and each of the pair of second engagement portions may be rotated about the coupling portion with respect to the core wire holding portion.

The coupling portion may be formed integrally with the core wire holding portion and each of the pair of second engagement portions.

When the pair of second engagement portions is moved through the opening into the housing in a direction opposite to the first direction so as to be arranged in the arrangement space, outer surfaces of the pair of second engagement portions may be brought into contact with the arrangement surface section so that a distance between inner surfaces of the pair of second engagement portions opposed to each other along the third direction is gradually decreased, and the pair of second engagement portions may connect to the one of end portions of the core wire holding portion with the distance The core wire holding portion may be configured to hold the plurality of core wires while dividing the plurality of core wires into groups each including at least one core wire.

The plurality of core wires may comprise a plurality of pairs of core wires, and the core wire holding portion may include a plurality of dividing portions configured to arrange the core wires along the first direction while dividing the core wires into the groups on a pairwise basis.

Each of the dividing portions may form a through-hole that extends along the first direction and is configured to allow passage of the pair of the core wires.

The connector may further comprise an alignment member configured to align the core wires along the first direction, and arranged in the arrangement space so as to be opposed to another of the end portions of the core wire holding portion along the first direction.

The first engagement portion may include a restricting portion configured to restrict movement of the engagement member in the first direction with respect to the housing through contact with at least one of the pair of second engagement portions under a state in which the first engagement portion locks the cable.

Each of the pair of second engagement portions may include a pressing surface portion forming one of a flat surface and a curved surface configured to press the outer surface of the cable.

The connector may further comprising a conductive shell including a shell body portion to be arranged around the housing; and a shell extending portion extending from the shell body portion toward the arrangement space, the shell extending portion being arranged to be opposed to the first engagement portion and configured to press an outer peripheral surface of the cable arranged in the arrangement space.

Each of the plurality of core wires may be formed of a coated electric wire, and the connector may further comprise a plurality of terminals respectively mounted to the plurality of core wires and arranged in the housing.

According to an aspect of this invention, a connector capable of firmly fixing a cable while reducing a risk of damaging the cable can be provided.

BRIEF DESCRIPTION OF THE DRAWINGS

FIG. 12 is a rear sectional view for illustrating the engagement member in one embodiment taken along a rear surface of a core wire holding portion.

FIG. 13 is a sectional view for illustrating the core wire holding portion taken along the line XIII-XIII of FIG. 12.

FIG. 14 is a sectional view for illustrating the core wire holding portion taken along the line XIV-XIV of FIG. 12.

FIG. 15 is a sectional view for illustrating the core wire holding portion taken along the line XV-XV of FIG. 12.

FIG. 16 a sectional view for illustrating the core wire holding portion taken along the line XVI-XVI of FIG. 12.

FIG. 17 is a perspective view for illustrating the engagement member in one embodiment when the pair of second engagement portions is at an increased width position, as seen from the upper right front side.

DESCRIPTION OF THE EMBODIMENTS

Now, with reference to the drawings, a connector according to one embodiment of this invention and a connector assembly are described. The same components are denoted by the same reference symbols in all of the drawings. Directional terms described in this embodiment, such as "front", "rear", "upper", "lower", "right", and "left", are used for ease of understanding of this embodiment, and do not limit this invention.

Figure 1:
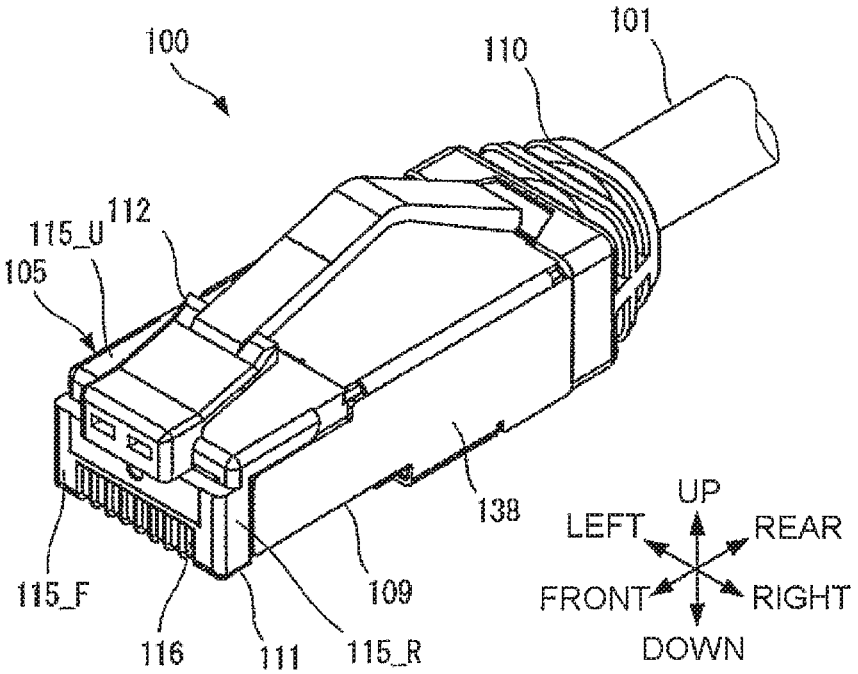
FIG. 1 is a perspective view for illustrating a connector according to one embodiment of this invention under a state in which a cable is connected to the connector, as seen from an upper right front side of the connector.
Figure 2:
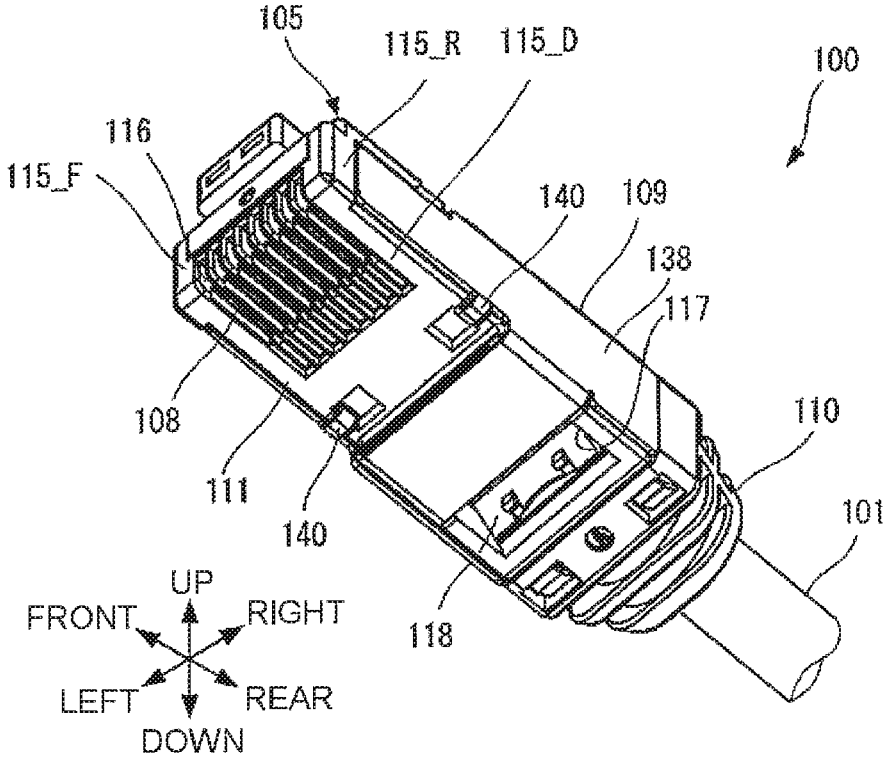
FIG. 2 is a perspective view for illustrating the connector according to one embodiment under a state in which the cable is connected to the connector, as seen from a lower right front side of the connector.

A connector 100 according to one embodiment of this invention is, as illustrated in FIG. 1 and FIG. 2 being perspective views of the connector 100, a connector to which an end portion 101_E of a cable 101 (see FIG. 3) including a plurality of core wires 103 is connected. The connector 100 and a mating connector (not shown) such as a modular jack are fitted to each other. The connector 100 is fitted to the mating connector, and thus electrically connects the core wires 103 of the cable 101 and wires (not shown) connected to the mating connector.

Here, FIG. 1 is a perspective view for illustrating the connector 100 according to this embodiment under a state in which the cable 101 is connected to the connector 100, as seen from an upper right front side of the connector. FIG. 2 is a perspective view for illustrating the connector 100 according to this embodiment under a state in which the cable 101 is connected to the connector 100, as seen from a lower right front side of the connector.

Figure 3:
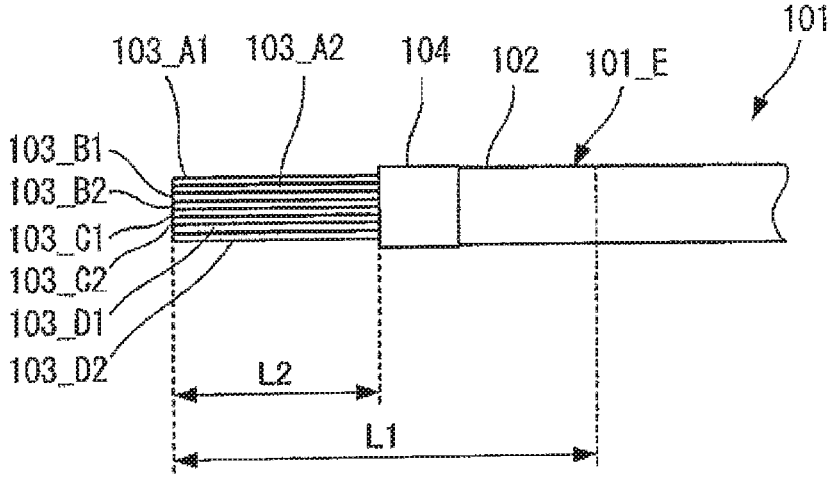
FIG. 3 is a side view for illustrating an end portion of the cable in one embodiment.

The cable 101 in this embodiment is a twisted pair cable suitably adopted for differential transmission. As illustrated in FIG. 3, the end portion 101_E of the cable 101 is a portion having a predetermined length L1 from a tip of the cable 101, and is arranged inside the connector 100. The end portion 101_E of the cable 101 includes a sheath member 102, eight core wires 103, and conductive foil 104. Here, FIG. 3 is a side view for illustrating the cable 101 as seen from a direction perpendicular to a length direction of the cable 101.

The sheath member 102 is an insulating member configured to bundle the eight core wires 103 and sheathe a periphery of the bundled core wires 103. In the end portion 101_E of the cable 101, a portion extending from the tip of the cable 101 by a predetermined length L2 ($L2<L1$) is not coated with the sheath member 102, and the core wires 103 are uncoated.

Each of the eight core wires 103 is an electric wire coated with an insulating member. The eight core wires 103 are paired by twisting every two core wires inside the sheath member 102. In this embodiment, the eight core wires 103 include a pair of a core wire 103_A1 and a core wire 103_A2, a pair of a core wire 103_B1 and a core wire 103_B2, a pair of a core wire 103_C1 and a core wire 103_C2, and a pair of a core wire 103_D1 and a core wire 103_D2. Each pair of core wires 103 uncoated at the end portion 101_E of the cable 101 is untwisted to extend substantially in parallel to each other.

Here, the core wires 103_A1, 103_A2, 103_B1, 103_B2, 103_C1, 103_C2, 103_D1, and 103_D2 are collectively called the core wires 103. When it is not particularly necessary to distinguish the core wires from each other, the core wires 103_A1, 103_A2, 103_B1, 103_B2, 103_C1, 103_C2, 103_D1, and 103_D2 are similarly represented as the core wires 103 also in the following description.

The conductive foil 104 is a thin film-like conductor made of, for example, metal. The conductive foil 104 is wound around an outer peripheral surface of the sheath member 102 within a predetermined range at the end portion 101_E of the cable 101. It is preferred that the conductive foil 104 be fixed to the outer peripheral surface of the sheath member 102 through, for example, bonding.

The number of the core wires 103 included in the cable 101 is not limited to eight. It is only required that a plurality of core wires 103 be provided. Further, three or more core wires 103 may be twisted inside the sheath member 102, or the core wires 103 may be individually arranged substantially in parallel to each other without being twisted inside the sheath member 102. Moreover, the core wire 103 is not limited to the coated electric wire configured to send and receive an electric signal. The core wire 103 may be, for example, an appropriately coated signal wire for sending and receiving an optical signal, or a coated electric wire for supply electric power.

As illustrated in any one of FIG. 1, FIG. 2, and FIG. 4 to FIG. 7, the connector 100 includes a housing 105, an engagement member 106, an alignment member 107, eight terminals 108, a conductive shell 109, and a boot 110.

Figure 4:
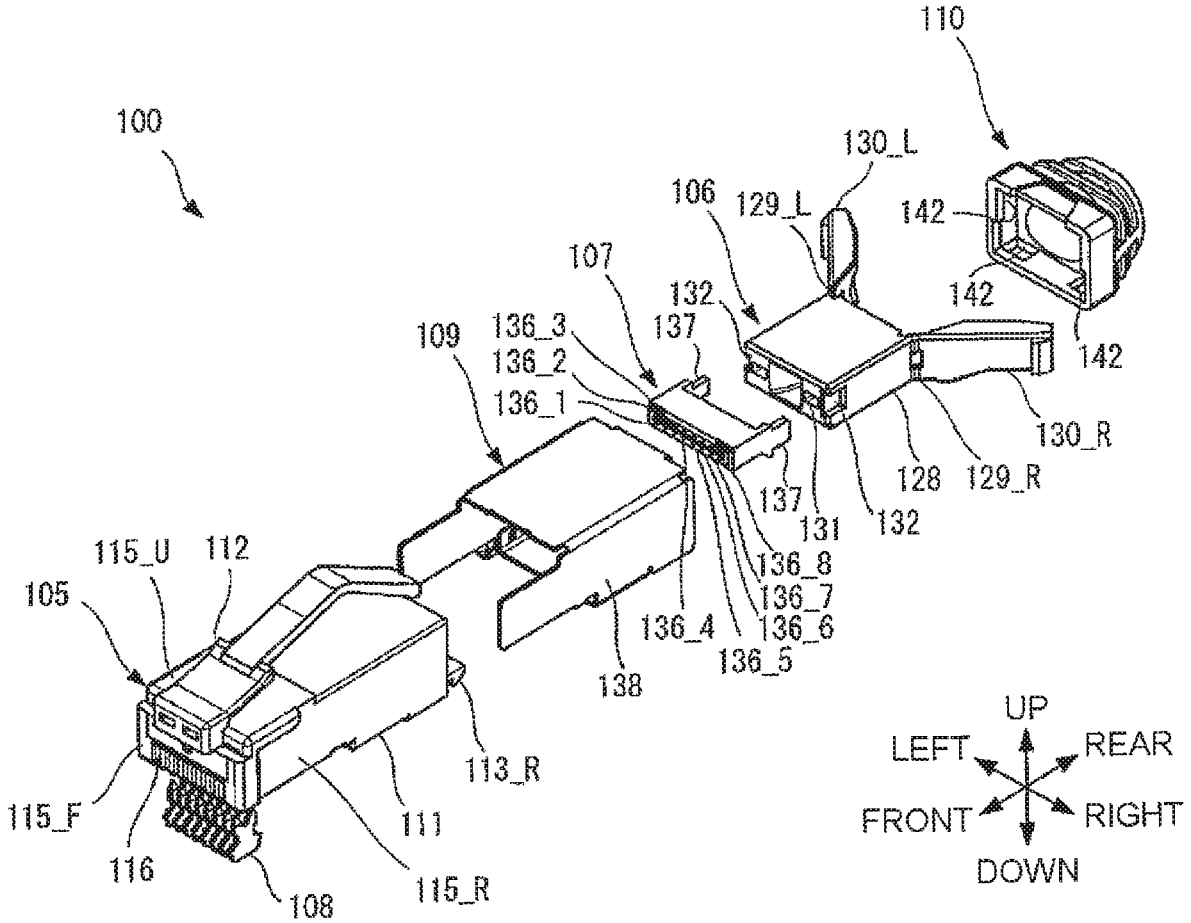
FIG. 4 is an exploded perspective view for illustrating the connector according to one embodiment, as seen from the upper right front side.
Figure 5:
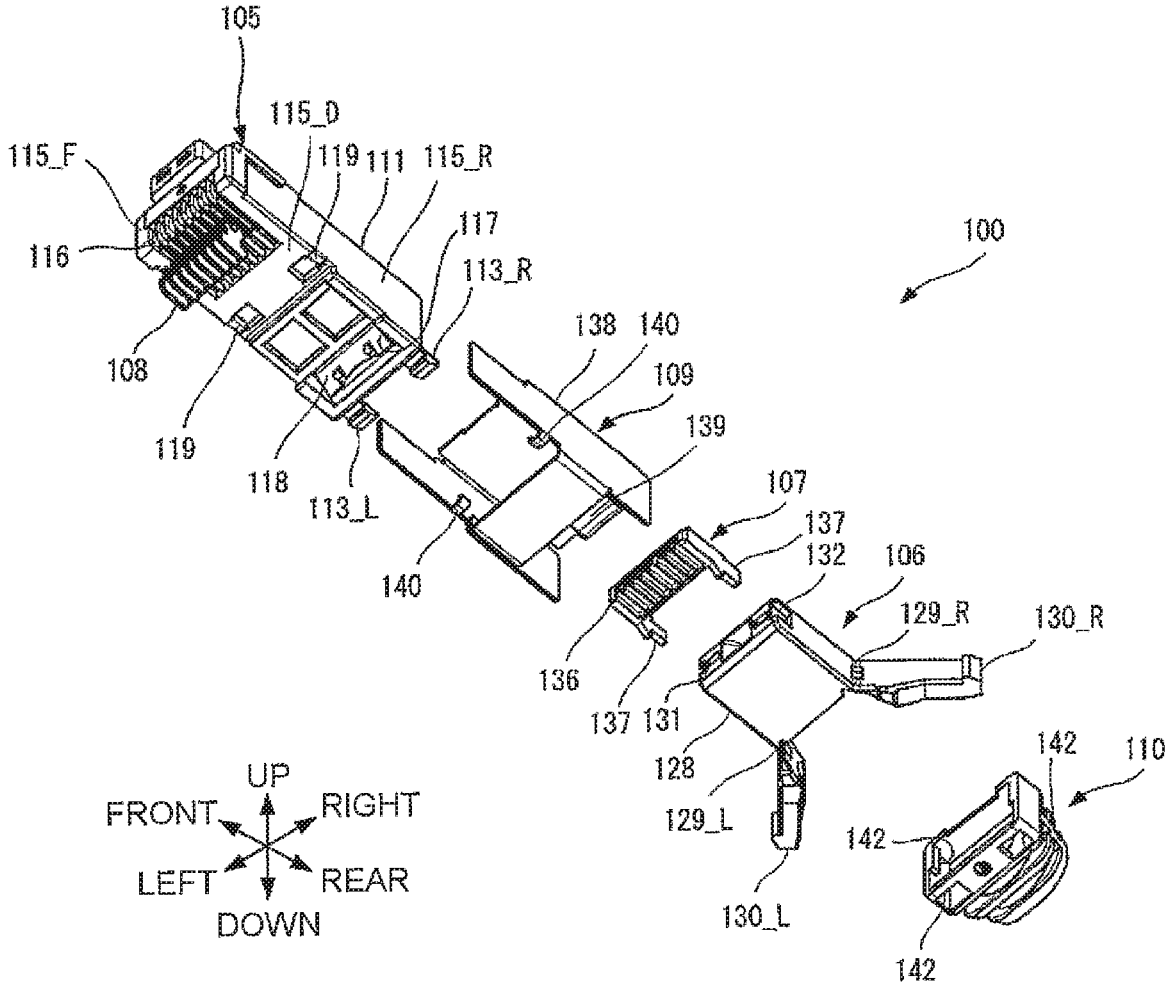
FIG. 5 is an exploded perspective view for illustrating the connector according to one embodiment, as seen from the lower right front side.
Figure 6:
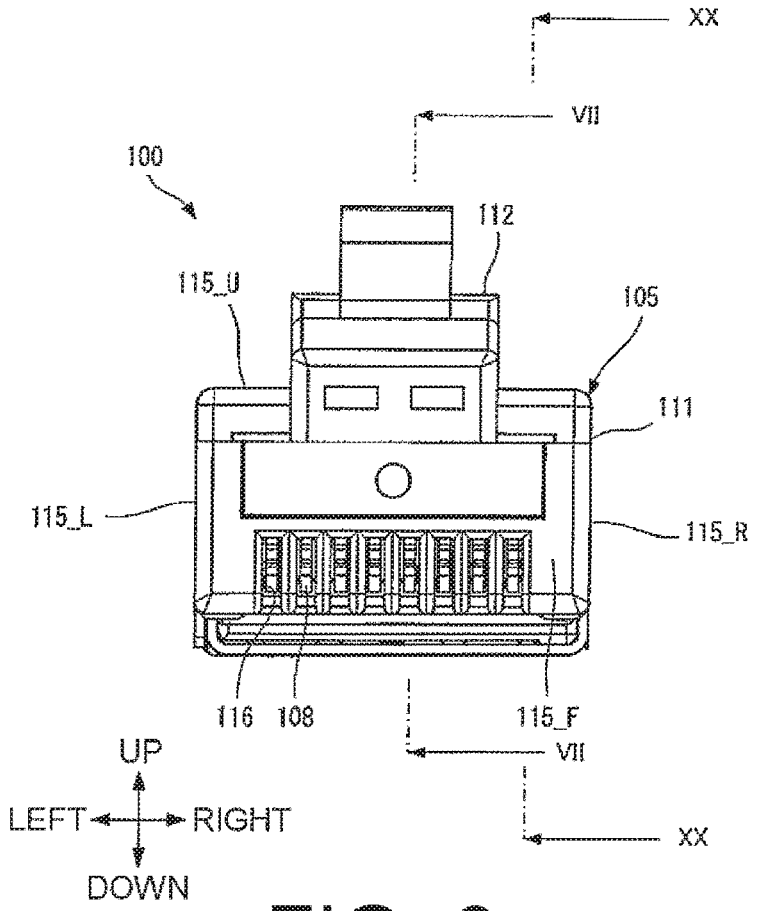
FIG. 6 is a front view for illustrating the connector according to one embodiment.
Figure 7:
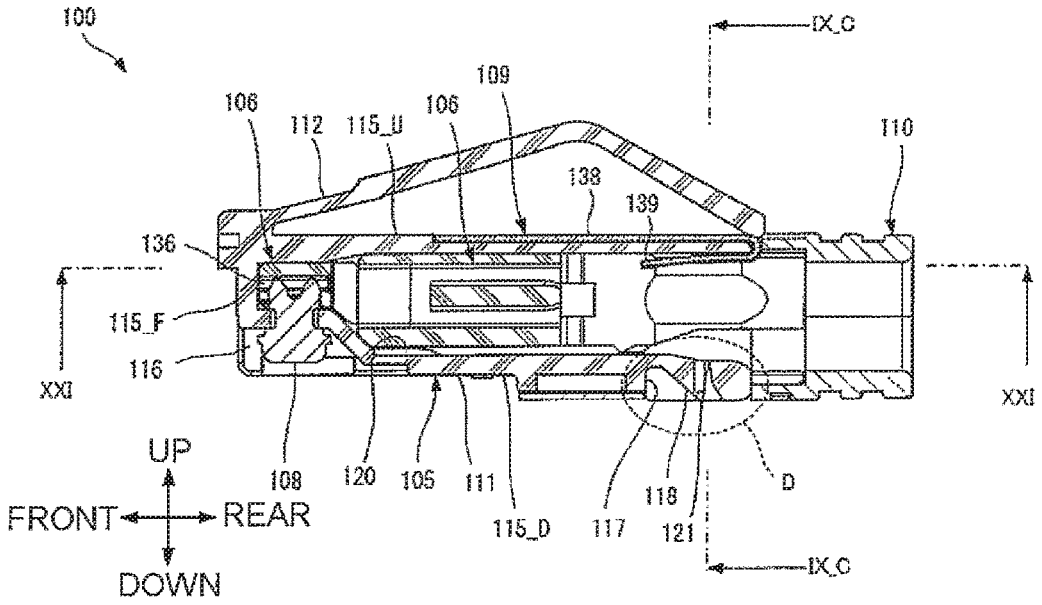
FIG. 7 is a sectional view for illustrating the connector taken along the line VII-VII of FIG. 6.

Here, FIG. 4 is an exploded perspective view for illustrating the connector 100 according to this embodiment, as seen from the upper right front side. FIG. 5 is an exploded perspective view for illustrating the connector 100 according to this embodiment, as seen from the lower right front side. FIG. 6 is a front view for illustrating the connector 100 according to this embodiment, as seen from a front side. FIG. 7 is a view for illustrating a cross section of the connector 100 taken along the line VII-VII of FIG. 6, as seen from a right side of the connector 100.

The housing 105 is a member configured to hold the end portion 101_E of the cable 101 arranged inside the housing 105. For example, the housing 105 is made of a resin and integrally formed by, for example, injection molding. As illustrated in FIG. 5 to FIG. 8, the housing 105 includes a housing body 111, a fit-engagement portion 112, and a pair of first boot mounting lance portions 113_L and 113_R.

Figure 8:
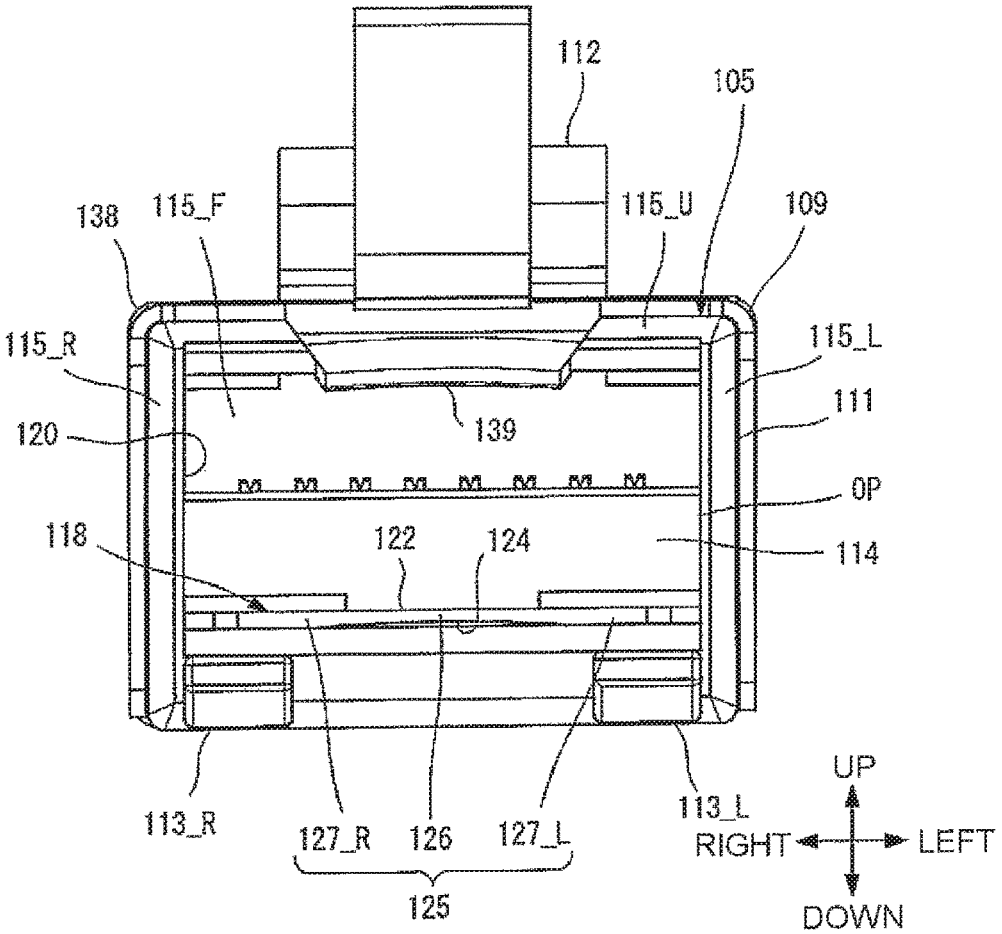
FIG. 8 is a rear view for illustrating a housing in one embodiment under a state in which a conductive shell is mounted to the housing.

Here, FIG. 8 is a rear view for illustrating the housing 105 in this embodiment under a state in which the conductive shell 109 is mounted to the housing 105.

The housing body 111 is a member having a substantially rectangular parallelepiped shape elongated in a front-and-rear direction thereof, and has an arrangement space 114 therein. The cable 101 is arranged in the arrangement space 114 through an opening OP formed in a rear end of the housing body 111.

Specifically, the housing body 111 includes a front wall portion 115_F, a left wall portion 115_L, a right wall portion 115_R, an upper wall portion 115_U, a lower wall portion 115_D, eight terminal receiving portions 116, a lower opening portion 117, a first engagement portion 118, and right and left shell engagement groove portions 119.

The front wall portion 115_F, the left wall portion 115_L, the right wall portion 115_R, the upper wall portion 115_U, and the lower wall portion 115_D are substantially rectangular flat-plate-like portions provided on front, left, right, upper, and lower sides of the housing body 111, respectively. An arrangement surface section 120, which forms inner surfaces of those wall portions 115_F, 115_L, 115_R, 115_U, and 115_D, defines the arrangement space 114 extending in a rearward direction from the inside of the housing body 111 toward the opening OP. Here, the rearward direction corresponds to a first direction.

The eight terminal receiving portions 116 are portions defining terminal spaces in which the eight terminals 108 are to be arranged, respectively. The terminal receiving portions 116 are provided so as to be aligned in a right-and-left direction of the connector 100. At a vicinity of a front end of the lower wall portion 115_D and a vicinity of a lower end of the front wall portion 115_F, the eight terminal receiving portions 116 form surfaces that connect outer surface portions of the lower wall portion 115_D and the front wall portion 115_F to the arrangement surface section 120, and thus define the terminal spaces continuously communicating with the arrangement space 114.

Here, the "vicinity" of the portion means a predetermined area around the portion.

It is only required that the terminal receiving portions 116 be provided so as to correspond to the terminals 108, respectively. The number of the terminal receiving portions 116 is not limited to eight.

The lower opening portion 117 is a portion defining a substantially rectangular opening formed at a vicinity of the rear end of the lower wall portion 115_D and elongated in the right-and-left direction, and allows communication between the outside of the housing body 111 and the arrangement space 114. At a portion forming a rear side of the lower opening portion 117, the lower opening portion 117 includes a return preventing portion 121 configured to prevent the first engagement portion 118 from returning from a holding position to an initial position.

Here, the "holding position" and the "initial position" respectively refer to a position of the first engagement portion 118 in a holding state and a position of the first engagement portion 118 in an initial state with respect to the housing body 111. Further, the "holding state" refers to a state in which the end portion 101_E of the cable 101 is held in the connector 100 so as to be prevented from slipping out of the arrangement space 114. The "initial state" refers to a state before the end portion 101_E of the cable 101 is arranged in the arrangement space 114.

Figure 9A:
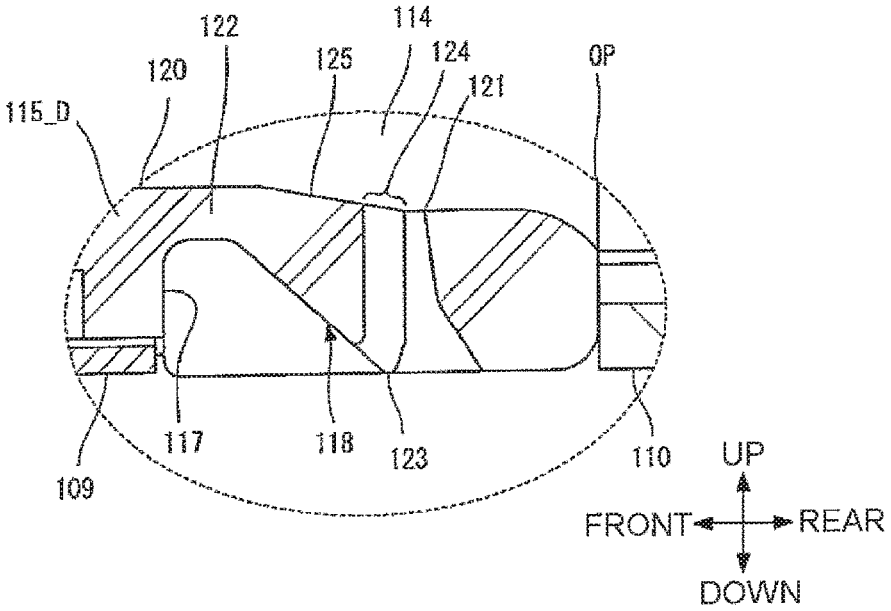
FIG. 9A is an enlarged view for illustrating a part of FIG. 7 indicated by the dotted circle D, and is an illustration of a first engagement portion brought to an initial position.
Figure 9B:
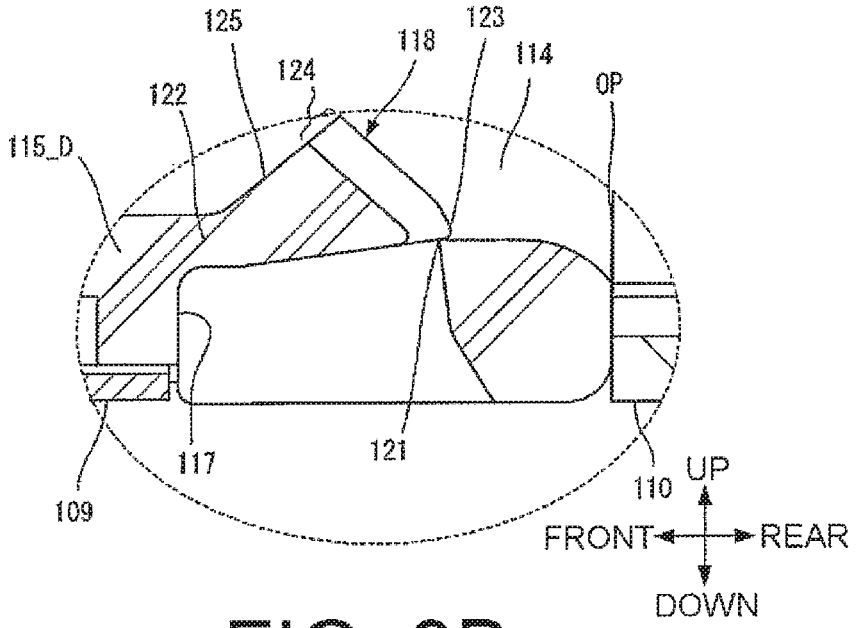
FIG. 9B is an enlarged view corresponding to FIG. 9A, and is an illustration of the first engagement portion brought to a holding position.

As illustrated in FIG. 9A and FIG. 9B, the first engagement portion 118 is a portion configured to lock the cable 101 in such a manner that the first engagement portion 118 is displaced in an upward direction so as to project into the arrangement space 114 in a projecting manner, and thus presses an outer surface of the cable 101 arranged in the arrangement space 114. That is, the first engagement portion 118 is moved substantially in the upward direction from the initial position, and thus is displaced to the holding position of engagement the cable 101.

Here, FIG. 9A is an enlarged view for illustrating a part of FIG. 7 indicated by the dotted circle D, and is an illustration of the first engagement portion 118 brought to the initial position. FIG. 9B is an enlarged view corresponding to FIG. 9A, and is an illustration of the first engagement portion 118 brought to the holding position.

Here, the upward direction corresponds to a second direction orthogonal to the first direction. Further, the "engagement" refers to a state in which at least mutual movement of members in one direction is prevented through engagement of the members owing to contact therebetween.

The first engagement portion 118 in this embodiment has a substantially triangular prism shape extending in the right-and-left direction. In a cross section of the first engagement portion 118 as seen from a side, the first locking portion 118 has a triangular shape in which a foremost apex (connection portion 122) connects to the lower opening portion 117, and an engagement surface portion 125 forming one of sides including the apex is arranged so as to be directed substantially in the upward direction. Note that a rear surface of the first engagement portion 118 is curved as described later.

More specifically, as illustrated in FIG. 8, FIG. 9A, and FIG. 9B, the first engagement portion 118 includes the connection portion 122, a first projecting portion 123, a second projecting portion 124, and the engagement surface portion 125.

As described above, the connection portion 122 is a portion forming the foremost apex as seen from a side of the connector, and connects to a portion of the lower opening portion 117 forming a front side. The connection portion 122 is made of a resin and has flexibility. Therefore, the first engagement portion 118 is moved to rotate about the connection portion 122 substantially in the upward direction (in a counterclockwise direction as seen from a right side of the connector). Through this rotational movement, the first engagement portion 118 is displaced from the initial position to the holding position.

The first projecting portion 123 is a portion forming a lower apex of apexes located on the rear side of the connection portion 122 as seen from the side of the connector. When the first engagement portion 118 is at the initial position, the first projecting portion 123 is positioned below the return preventing portion 121 (see FIG. 9A). When the first engagement portion 118 is displaced to the holding position, the first projecting portion 123 in the holding state is positioned above the return preventing portion 121 (see FIG. 9B).

In the a course of displacement of the first engagement portion 118 from the initial state to the holding state, the first projecting portion 123 comes into contact with the return preventing portion 121. On this occasion, when the first projecting portion 123 is pressed in the upward direction so that the first projecting portion 123 is pressed by the return preventing portion 121, the first engagement portion 118 made of a resin is elastically deformed. Thus, the first projecting portion 123 can be moved in the upward direction while being held in contact with the return preventing portion 121. After passing a front of the return preventing portion 121, the first engagement portion 118 is restored to the same shape as that in the initial state owing to its elasticity. As a result, the first projecting portion 123 comes into contact with the return preventing portion 121, and thus is prevented from moving in a downward direction.

The second projecting portion 124 is a portion forming an upper apex of the apexes located on the rear side of the connection portion 122 as seen from the side of the connector. In a course of displacement of the first engagement portion 118 from the initial position to the holding position, the second projecting portion 124 is moved substantially in the upward direction, and then is positioned in the arrangement space 114 in a projecting manner when the first engagement portion 118 is at the holding position. In this manner, the second projecting portion 124 brought to the holding position presses and locks the outer surface of the end portion 101_E of the cable 101. At the initial position, the second projecting portion 124 is positioned so as to allow the cable 101 to move above the second projecting portion 124.

Figure 9C:
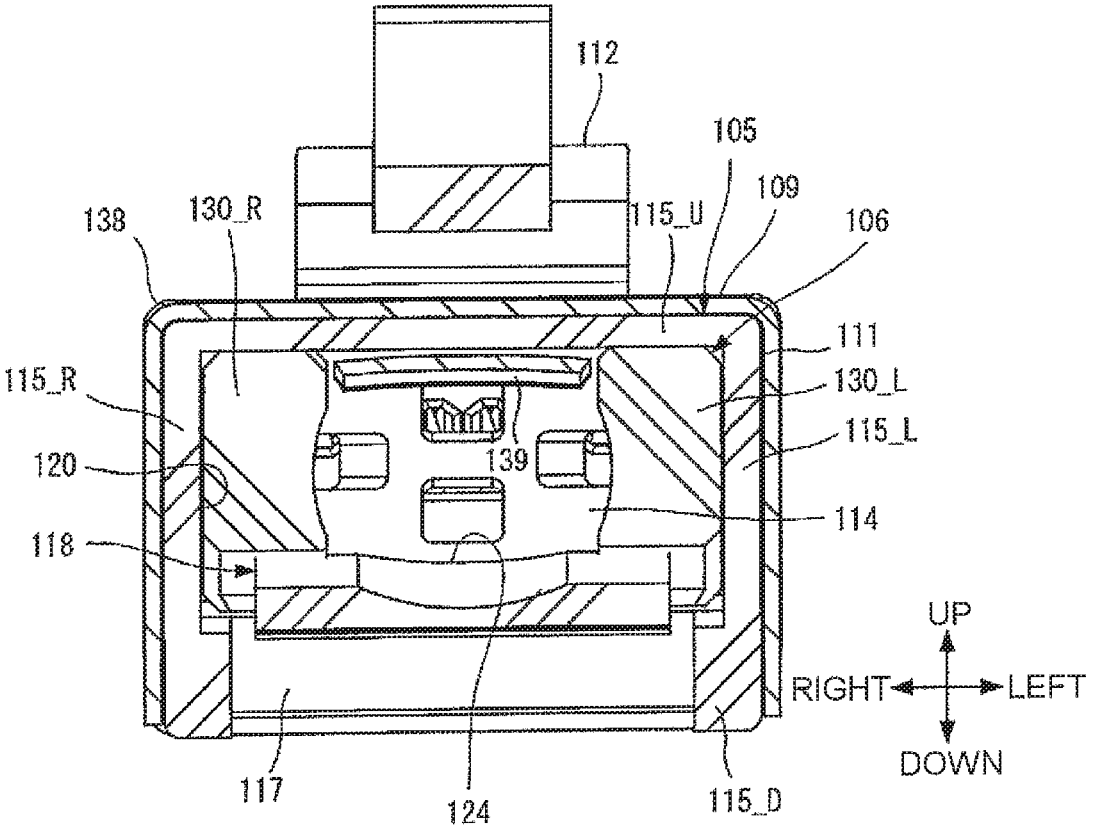
FIG. 9C is a rear sectional view taken along the line IX_C-IX_C of FIG. 7, and is an illustration of the connector when the first engagement portion is at the holding position.

In this embodiment, when the second projecting portion 124 at the holding position is seen from a rear side of the connector, as illustrated in FIG. 9C, the second projecting portion 124 includes an arc-shaped curved portion that is formed at a substantially center thereof in the right-and-left direction to project in the downward direction. Here, FIG. 9C is a sectional view for illustrating the connector 100 taken along the line IX_C-IX_C of FIG. 7 when the first engagement portion 118 is at the holding position, as seen from the rear side. The second projecting portion 124 includes the curved portion as described above, and hence is indicated by the line rather than the point in FIG. 9A and FIG. 9B.

It is desired that a curvature radius of the curved portion of the second projecting portion 124 be larger than a curvature radius of the cable 101. The curvature radius of the cable 101 corresponds to a radius of the cable 101, in other words, a radius of a circle formed by the outer surface of the cable 101 in a cross section perpendicular to an extending direction of the cable 101.

The engagement surface portion 125 is, for example, a portion connecting the connection portion 122 and the second projecting portion 124 as illustrated in FIG. 8 and FIG. 9A for illustrating the initial state and FIG. 9B for illustrating the holding state. The engagement surface portion 125 forms a substantially rectangular flat surface. However, a rear edge portion of the engagement surface portion 125 includes a portion curved so as to project toward the inside of the connector.

Specifically, as illustrated in FIG. 8, the engagement surface portion 125 includes a cable engagement portion 126, a left restricting portion 127_L, and a right restricting portion 127_R. The engagement surface portion 125 is inclined slightly in the rearward direction and directed in the upward direction at the initial position. The engagement surface portion 125 is directed upward and forward at the holding position.

At the initial position, the cable engagement portion 126 is positioned so as to allow the cable 101 to pass above the cable engagement portion 126. At the holding position, the cable engagement portion 126 presses, together with the second projecting portion 124, the outer surface of the cable 101 arranged in the arrangement space 114, and locks the cable 101 so as to prevent the cable 101 from moving in the rearward direction with respect to the housing 105.

The left restricting portion 127_L and the right restricting portion 127_R are portions located on left and right sides of the cable engagement portion 126, respectively. At the initial position, the restricting portions 127_L and 127_R are positioned so as to allow the engagement member 106 (described later in detail) to pass above the restricting portions 127_L and 127_R. At the holding position, the restricting portions 127_L and 127_R restrict rearward movement of the engagement member 106 with respect to the housing 105 through contact with the engagement member 106.

As illustrated in FIG. 5, the right and left shell engagement groove portions 119 are portions forming grooves in a lower surface of the lower wall portion 115_D, and are formed between the lower opening portion 117 and the terminal receiving portions 116 at substantially the same positions in the front-and-rear direction. In this embodiment, the right and left shell engagement groove portions 119 form grooves opened rightward and leftward directions, respectively. Only any one of the right and left shell engagement groove portions 119 may be formed, or a groove continuous in the right-and-left direction may be formed.

As illustrated in, for example, FIG. 1, the fit-engagement portion 112 is a portion formed on an upper portion of the housing body 111. When the connector 100 is fitted to the mating connector, the fit-engagement portion 112 removably locks the connector 100 so as to prevent the connector 100 from slipping out of the mating connector.

As illustrated in, for example, FIG. 5, each of the pair of first boot mounting lance portions 113_L and 113_R is a portion extending from the rear end of the lower wall portion 115_D in the rearward direction, and includes a lance projecting in the downward direction so as to lock the boot 110 at the vicinity of the rear end.

The engagement member 106 is a member arranged in the arrangement space 114 and configured to hold the cable 101 in the arrangement space 114 together with the housing 105. For example, the engagement member 106 is made of a resin and integrally formed by, for example, injection molding.

Figure 10:
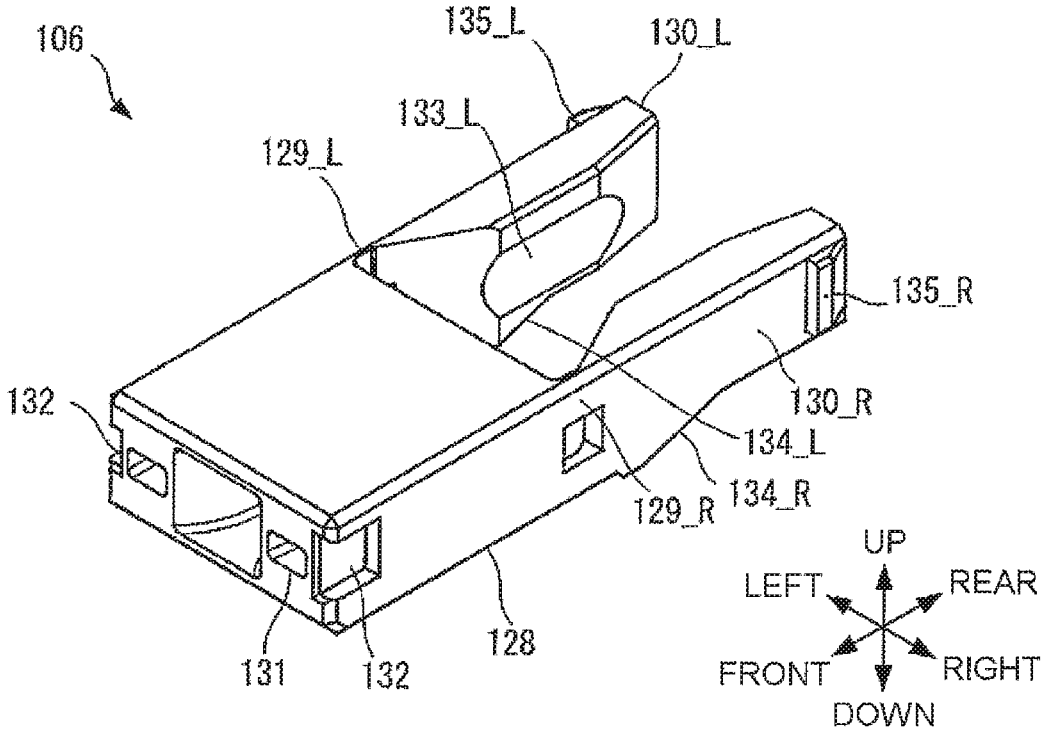
FIG. 10 is a perspective view for illustrating a engagement member in one embodiment when a pair of second engagement portions is at an engagement position, as seen from the upper right front side.
Figure 11:
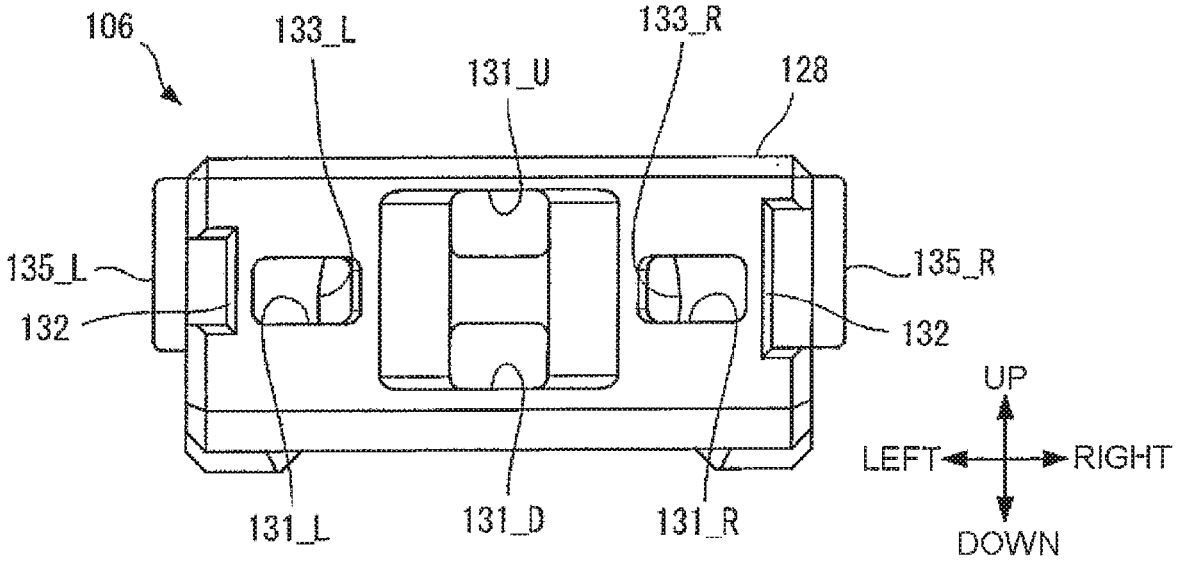
FIG. 11 is a front view for illustrating the engagement member in one embodiment when the pair of second engagement portions is at the engagement position.

Specifically, as illustrated in FIG. 10 and FIG. 11, the engagement member 106 includes a core wire holding portion 128, coupling portions 129_L and 129_R, and a pair of second engagement portions 130_L and 130_R.

Here, FIG. 10 is a perspective view for illustrating the engagement member 106 in this embodiment when the pair of second engagement portions 130_L and 130_R is at an engagement position (described later in detail), as seen from the upper right front side. FIG. 11 is a front view for illustrating the engagement member 106 in this embodiment when the pair of second engagement portions 130_L and 130_R is at the engagement position (described later in detail), as seen from the front side.

The core wire holding portion 128 is a portion having a substantially rectangular parallelepiped shape, and is configured to hold, on a pairwise basis, the core wires 103 of the cable 101 untwisted after being uncoated from the sheath member 102.

Specifically, as illustrated in FIG. 10 to FIG. 16, the core wire holding portion 128 includes four dividing portions 131 and a pair of fitting groove portions 132.

Here, FIG. 12 is a sectional view for illustrating the engagement member 106 in this embodiment taken along a rear surface of the core wire holding portion 128, and is an illustration of the core wire holding portion 128 as seen from the rear side. FIG. 13 is a sectional view for illustrating the core wire holding portion 128 taken along the line XIII-XIII of FIG. 12, as seen from an upper side of the connector. FIG. 14 is a sectional view for illustrating the core wire holding portion 128 taken along the line XIV-XIV of FIG. 12, as seen from the upper side of the connector. FIG. 15 is a sectional view for illustrating the core wire holding portion 128 taken along the line XV-XV of FIG. 12, as seen from the right side of the connector. FIG. 16 is a sectional view for illustrating the core wire holding portion 128 taken along the line XVI-XVI of FIG. 12, as seen from the right side of the connector.

The four dividing portions 131 are portions forming through-holes in the front-and-rear direction, and include dividing portions 131_U, 131_D, 131_L, and 131_R located on the upper, lower, left, and right sides of the connector, respectively. Here, the dividing portions 131_U, 131_D, 131_L, and 131_R located respectively on the upper, lower, left, and right sides are collectively called the dividing portions 131. When it is not particularly necessary to distinguish the dividing portions from each other, the dividing portions 131_U, 131_D, 131_L, and 131_R are similarly represented as the dividing portions 131 also in the following description.

The through-hole formed by each of the dividing portions 131 is a through-hole extending in the front-and-rear direction (that is, extending along the first direction) so as to allow passage of the pair of core wires 103. As illustrated by the dotted circles in FIG. 12, the pairs of core wires 103 are allowed to pass through the dividing portions 131. In this manner, the core wires 103 can be arranged in the front-and-rear direction under a state of being divided into groups including the pairs of core wires 103.

It is only required that the core wire holding portion 128 hold the core wires 103 while dividing the core wires 103 into groups. The number of the core wires 103 in each of the groups is not limited to two. Each of the groups may include one core wire 103, or three or more core wires 103. Further, the number of the groups for dividing the core wires 103 is not limited to four, and it is only required that the number of the groups be at least one. Further, it is only required that the dividing portions 131 be configured to arrange the core wires 103 in the front-and-rear direction while dividing the core wires 103 on the pairwise basis. For example, as the dividing portions 131, grooves may be formed in an outer surface of the core wire holding portion 128.

The pair of fitting groove portions 132 are portions forming grooves in right and left outer side surfaces of the core wire holding portion 128, and extend from the front end of the core wire holding portion 128 in the rearward direction by a predetermined length.

The coupling portions 129_L and 129_R are portions coupling the core wire holding portion 128 and the pair of second engagement portions 130_L and 130_R.

Specifically, the coupling portion 129_L couples a left end portion of a rear surface portion of the core wire holding portion 128 and a front end portion of the second engagement portion 130_L. The coupling portion 129_R couples a right end portion of the rear surface portion of the core wire holding portion 128 and a front end portion of the second engagement portion 130_R.

Here, the rear surface portion of the core wire holding portion 128 is a portion forming a surface of the core wire holding portion 128 in this embodiment directed in the rearward direction. The rear surface portion corresponds to one of end portions of the core wire holding portion 128 along the first direction.

Each of the coupling portions 129_L and 129_R is elongated in an up-and-down direction of the engagement member 106 and has a small width in the right-and-left direction. Each of the coupling portions 129_L and 129_R is made of a resin. Therefore, the coupling portions 129_L and 129_R can be elastically deformed. Thus, the second engagement portions 130_L and 130_R are rotated with respect to the core wire holding portion 128 about the coupling portions 129_L and 129_R serving as rotation axes (centers) substantially in the up-and-down direction. As illustrated in FIG. 10, each of the coupling portions 129_L and 129_R in this embodiment has a through-hole in a halfway portion thereof in the up-and-down direction. Thus, each of the coupling portions 129_L and 129_R can be flexibly deformed as compared to a case without the through-hole. With this configuration, the coupling portions 129_L and 129_R can be more easily rotated.

The pair of second engagement portions 130_L and 130_R in the holding state is arranged in the arrangement space 114. In this case, a left outer surface of the second engagement portion 130_L and a right outer surface of the second engagement portion 130_R are held in contact with the arrangement surface section 120 so that the second engagement portions 130_L and 130_R are arranged in an opposing manner in the right-and-left direction to extend substantially in parallel to each other. Inner surfaces of the pair of second engagement portions 130_L and 130_R in the holding state press and sandwich the outer surface of the cable 101 arranged in the arrangement space 114. In this manner, the pair of second engagement portions 130_L and 130_R locks the cable 101.

Here, the rightward or leftward direction in this embodiment corresponds to a third direction. Arrangement in an opposing manner along the right-and-left direction corresponds to arrangement in an opposing manner along the third direction that is orthogonal to the first direction and intersects the second direction.

In this embodiment, the second engagement portion 130_L connects to the left end portion of the rear surface portion of the core wire holding portion 128 through intermediation of the coupling portion 129_L, and extends substantially in the rearward direction. The second engagement portion 130_R connects to the right end portion of the rear surface portion of the core wire holding portion 128 through intermediation of the coupling portion 129_R, and extends substantially in the rearward direction.

As described above, the second engagement portions 130_L and 130_R can be rotated with respect to the core wire holding portion 128 about the coupling portions 129_L and 129_R serving as the rotation axes. With this configuration, the second engagement portions 130_L and 130_R are displaced substantially in the right-and-left direction while changing a distance therebetween, and are displaced between an engagement position illustrated in FIG. 10 and FIG. 11 and an increased width position illustrated in FIG. 17 to FIG. 19.

Here, the "engagement position" refers to a position at which the second engagement portions 130_L and 130_R are in the holding state, and the second engagement portions 130_L and 130_R extend in the front-and-rear direction in parallel to each other with the distance between the inner surfaces corresponding to a size of the cable 101. At the engagement position, the pair of second engagement portions 130_L and 130_R sandwiches the cable 101 arranged therebetween in the front-and-rear direction.

Further, the "increased width position" refers a position at which the second engagement portions 130_L and 130_R are in the initial state, and the second engagement portions 130_L and 130_R are respectively displaced substantially in the leftward direction and the rightward direction so that the distance between the inner surfaces is larger than the thickness of the cable 101.

Figure 18:
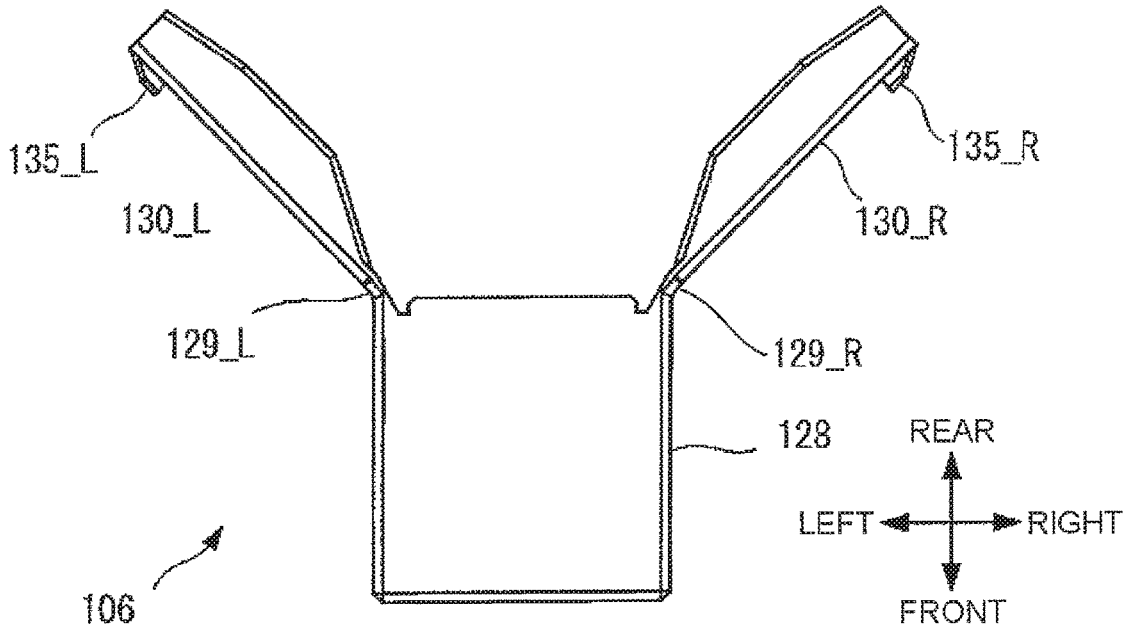
FIG. 18 is a plan view for illustrating the engagement member in this embodiment when the pair of second engagement portions is at the increased width position.
Figure 19:
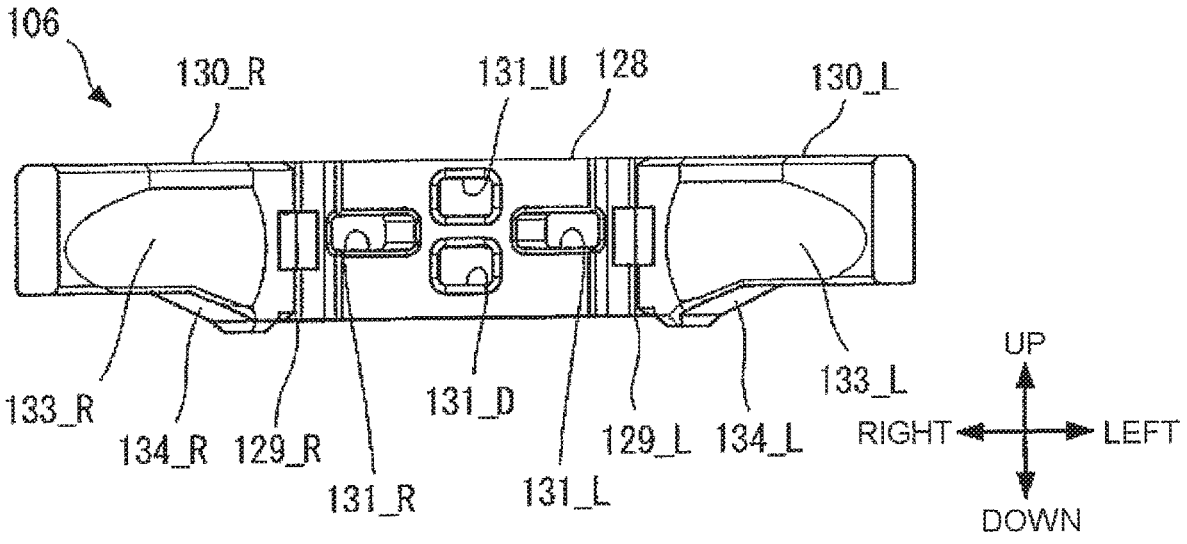
FIG. 19 is a rear view for illustrating the engagement member in this embodiment when the pair of second engagement portions is at the increased width position.

FIG. 17 is a perspective view for illustrating the engagement member 106 in this embodiment when the pair of second engagement portions 130_L and 130_R is at the increased width position, as seen from the upper right front side. FIG. 18 is a plan view for illustrating the engagement member 106 in this embodiment when the pair of second engagement portions 130_L and 130_R is at the increased width position, as seen from the upper side. FIG. 19 is a rear view for illustrating the engagement member 106 in this embodiment when the pair of second engagement portions 130_L and 130_R is at the increased width position, as seen from the rear side.

When the second engagement portions 130_L and 130_R are moved in the forward direction toward the housing 105 through the opening OP so as to be arranged in the arrangement space 114, the second engagement portions 130_L and 130_R are moved while the outer surfaces thereof are held in contact with the arrangement surface section 120. Here, the forward direction corresponds to a direction opposite to the first direction. Further, regarding the outer surfaces of the second engagement portions 130_L and 130_R, the outer surface of the second engagement portion 130_L is directed in the leftward direction, and the outer surface of the second engagement portion 130_R is directed in the rightward direction.

With this configuration, the distance between the inner surfaces of the second engagement portions 130_L and 130_R opposed to each other in the right-and-left direction is gradually decreased. With such distance between the outer surfaces, the second engagement portions 130_L and 130_R indirectly connect to a rear end portion of the core wire holding portion 128 through intermediation of the coupling portions 129_L and 129_R.

Specifically, the second engagement portions 130_L and 130_R each have a substantially rectangular parallelepiped shape elongated in the front-and-rear direction. The second engagement portion 130_L includes a pressing surface portion 133_L, a restricted portion 134_L, and a second boot mounting lance portion 135_L. The second engagement portion 130_R includes a pressing surface portion 133_R, a restricted portion 134_R, and a second boot mounting lance portion 135_R.

The pressing surface portions 133_L and 133_R are portions forming curved surfaces configured to press the outer surface of the cable 101 arranged in the arrangement space 114, and are opposed to each other substantially in the right-and-left direction.

Specifically, the pressing surface portion 133_L is a belt-shaped curved portion extending in the forward direction from a vicinity of the rear end of the inner surface (surface directed substantially in the rightward direction) of the second engagement portion 130_L, and the pressing surface portion 133_R is a belt-shaped curved portion extending in the forward direction from a vicinity of the rear end of the inner surface (surface directed substantially in the leftward direction) of the second engagement portion 130_R. When the second engagement portions 130_L and 130_R are brought to the engagement position, the pressing surface portions 133_L and 133_R extend in the front-and-rear direction substantially in parallel to each other, and are opposed to each other in the right-and-left direction.

More specifically, the curved surface formed by the pressing surface portion 133_L has a partial cylindrical shape that is curved to project in the leftward direction. The curved surface formed by the pressing surface portion 133_R has a partial cylindrical shape that is curved to project in the rightward direction. The partial cylindrical shape substantially corresponds to a shape obtained by cutting out an outer surface of a cylinder along a plane parallel to an axis of the cylinder.

That is, the curved surface formed by each of the pressing surface portions 133_L and 133_R has an arc shape as seen from an extending direction of the second engagement portions 130_L and 130_R. It is desired that a curvature radius of the arc formed by each of the pressing surface portions 133_L and 133_R be equal to or larger than the curvature radius of the cable 101.

Each of the pressing surface portions 133_L and 133_R may be a flat surface, or have a partial prism shape obtained by connecting a plurality of flat surfaces. The partial prism shape substantially corresponds to a shape obtained by cutting out an outer surface of a prism along a plane parallel to an axis of the prism.

As illustrated in, for example, FIG. 10 and FIG. 19, the restricted portions 134_L and 134_R are portions forming inclined surfaces that are formed at vicinities of the front ends of the lower surface portions of the second engagement portions 130_L and 130_R and are directed downward and rearward.

The restricted portions 134_L and 134_R in the holding state are respectively held in contact with the restricting portions 127_L and 127_R, or are respectively opposed to the restricting portions 127_L and 127_R substantially in the front-and-rear direction with a predetermined distance. With this configuration, when the engagement member 106 is moved toward the housing 105, the restricting portions 127_L and 127_R in the holding state are respectively brought into contact with the restricted portions 134_L and 134_R, thereby restricting rearward movement of the engagement member 106 with respect to the housing 105.

Only any one of the restricted portions 134_L and 134_R may be formed at a rear lower end of the second engagement portion 130_L or the second engagement portion 130_R. Even with this configuration, one of the restricted portions 134_L and 134_R may be brought into contact with the restricting portion 127_L or the restricting portion 127_R opposed thereto under the holding state, thereby restricting rearward movement of the engagement member 106 with respect to the housing 105.

The second boot mounting lance portions 135_L and 135_R are formed at vicinities of the rear ends of the second engagement portions 130_L and 130_R, and form lances projecting in the leftward direction and the rightward direction so as to lock the boot 110.

The alignment member 107 is a member configured to align the core wires 103 along the front-and-rear direction in front of the engagement member 106. The alignment member 107 is arranged in the arrangement space 114 so that the rear surface portion of the alignment member 107 is opposed to the front end portion of the core wire holding portion 128 at a predetermined distance.

Here, alignment along the front-and-rear direction corresponds to alignment along the first direction. The front end portion of the core wire holding portion 128 corresponds to another end portion of end portions of the core wire holding portion 128 along the first direction.

As illustrated in FIG. 4 and FIG. 5, the alignment member 107 includes eight alignment hole portions 136 and a pair of extending portions 137.

The eight alignment hole portions 136 are portions forming holes that are arrayed in the right-and-left direction and pass through the alignment member 107 in the front-and-rear direction. The eight core wires 103 are arranged so as to be inserted through the alignment hole portions 136 in the front-and-rear direction, respectively. When the eight alignment hole portions 136 are arranged in the arrangement space 114, the alignment hole portions 136 are arranged so as to correspond to positions of the eight terminal receiving portions 116 in the right-and-left direction, respectively. At least a part of a hole formed by each of the alignment hole portions 136 is opened in the downward direction so as to communicate with the terminal space formed by corresponding one of the terminal receiving portions 116.

Here, alignment hole portions 136_1, 136_2, 136_3, 136_4, 136_5, 136_6, 136_7, and 136_8 formed in the stated order from the left side are collectively called the alignment hole portions 136. When it is not particularly necessary to distinguish the alignment hole portions from each other, the alignment hole portions 136_1, 136_2, 136_3, 136_4, 136_5, 136_6, 136_7, and 136_8 are similarly represented as the alignment hole portions 136 also in the following description.

The pair of extending portions 137 are portions extending in the rearward direction from a left end and a right end of the alignment member 107, and are fitted to the fitting groove portions 132 corresponding to the extending portions 137 in the right-and-left direction. When the extending portions 137 and the fitting groove portions 132 are fitted to each other so as to be held in contact with each other in the front-and-rear direction, the alignment member 107 is positioned with respect to the engagement member 106.

As illustrated in FIG. 4 and FIG. 5, the eight terminals 108 are conductive members to be arranged in the eight terminal receiving portions 116, respectively. Specifically, the eight terminals 108 are respectively fixed to the eight core wires 103 untwisted at the end portion of the cable 101 arranged in the arrangement space 114, and are held in the housing 105.

It is only required that the terminals 108 be provided so as to correspond to the core wires 103 of the cable 101, respectively. The number of the terminals 108 is not limited to eight.

As illustrated in, for example, FIG. 1, FIG. 2, and FIG. 4 to FIG. 8, the conductive shell 109 is a member to be arranged around the housing 105. The conductive shell 109 is made of a conductive material such as metal and integrally formed. The conductive shell 109 is formed by, for example, bending a flat plate cut into a predetermined shape.

Specifically, the conductive shell 109 includes a shell body portion 138, a shell extending portion 139, and right and left engagement lance portions 140.

The shell body portion 138 is a portion to be arranged around the housing 105, and includes substantially rectangular wall portions arranged on the upper, lower, right, and left sides of the housing 105.

The left wall portion and the right wall portion of the shell body portion 138 are portions to be arranged on the left side and the right side of the housing 105, respectively. The upper wall portion of the shell body portion 138 is arranged behind the fit-engagement portion 112 to connect right and left wall portions of the housing 105 above the housing 105. The lower wall portion of the shell body portion 138 is arranged between the lower opening portion 117 and the shell engagement groove portions 119 to connect the right and left wall portions of the housing 105 below the housing 105.

The shell extending portion 139 is a portion extending from the shell body portion 138 toward the arrangement space 114. The shell extending portion 139 is arranged to be opposed to the first engagement portion 118 in the up-and-down direction, and is configured to press the outer peripheral surface of the cable 101 arranged in the arrangement space 114.

Specifically, the shell extending portion 139 is curved or bent at the rear end of the shell body portion 138 to pass the rear side of the upper wall portion 115_U, and extends in the forward direction in the arrangement space 114 through the opening of the housing 105. The shell extending portion 139 is brought into contact with the conductive foil 104 of the cable 101 arranged in the arrangement space 114, thereby pressing the outer surface of the cable 101 in the downward direction.

In this embodiment, as illustrated in, for example, FIG. 8, the shell extending portion 139 is curved in an arc shape projecting in the upward direction as seen from the rear side thereof. It is desired that a curvature radius of the shell extending portion 139 be larger than the curvature radius of the cable 101.

The right and left engagement lance portions 140 are portions extending from the right wall portion and the left wall portion of the shell body portion 138 while curving or bending. The left engagement lance portion 140 extends in the rightward direction to be arranged in the left shell engagement groove portion 119. The right engagement lance portion 140 extends in the leftward direction to be arranged in the right shell engagement groove portion 119. In this manner, when the engagement lance portions 140 are fitted to the corresponding right and left shell engagement groove portions 119, respectively, the conductive shell 109 is fixed to the housing 105.

The conductive shell 109 may be omitted. In this case, the conductive foil 104 may be omitted in the cable 101. Further, a portion corresponding to the shell extending portion 139 may be formed integrally with the housing 105 at, for example, the arrangement surface section 120 of the upper part of the housing body 111. Here, the portion corresponding to the shell extending portion 139 refers to a portion that extends in the forward direction from the vicinity of the opening in the arrangement space 114, is arranged to be opposed to the first engagement portion 118, and is configured to press the outer peripheral surface of the cable 101 arranged in the arrangement space 114. Similarly to the shell extending portion 139, this portion may be curved in an arc shape projecting in the upward direction as seen from the rear side thereof.

As illustrated in, for example, FIG. 4, FIG. 5, FIG. 20, and FIG. 21, the boot 110 is a member configured to protect the cable 101 extending from the arrangement space 114 in the rearward direction, and is made of, for example, a resin.

Figure 20:
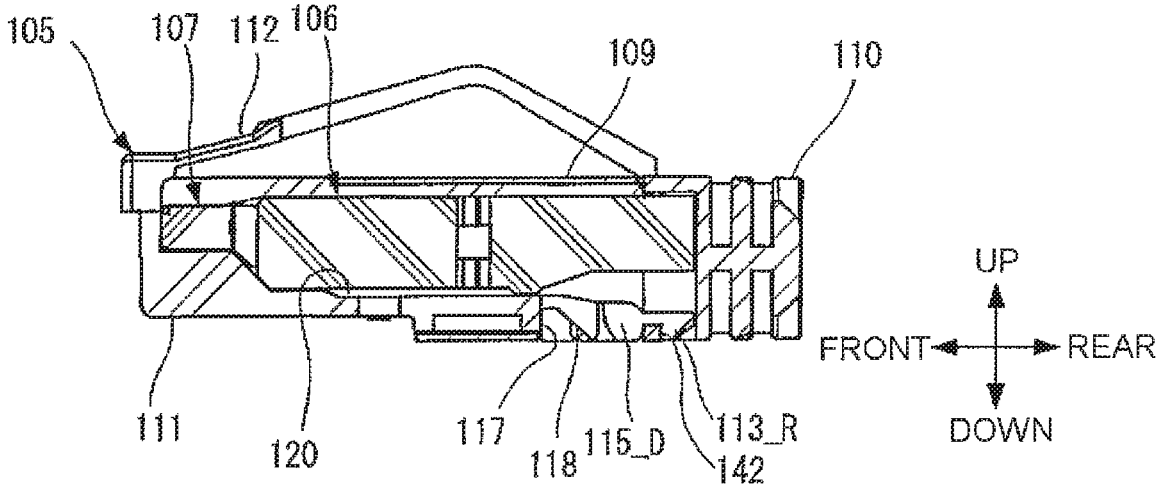
FIG. 20 is a sectional view for illustrating the connector taken along the line XX-XX of FIG. 6.
Figure 21:
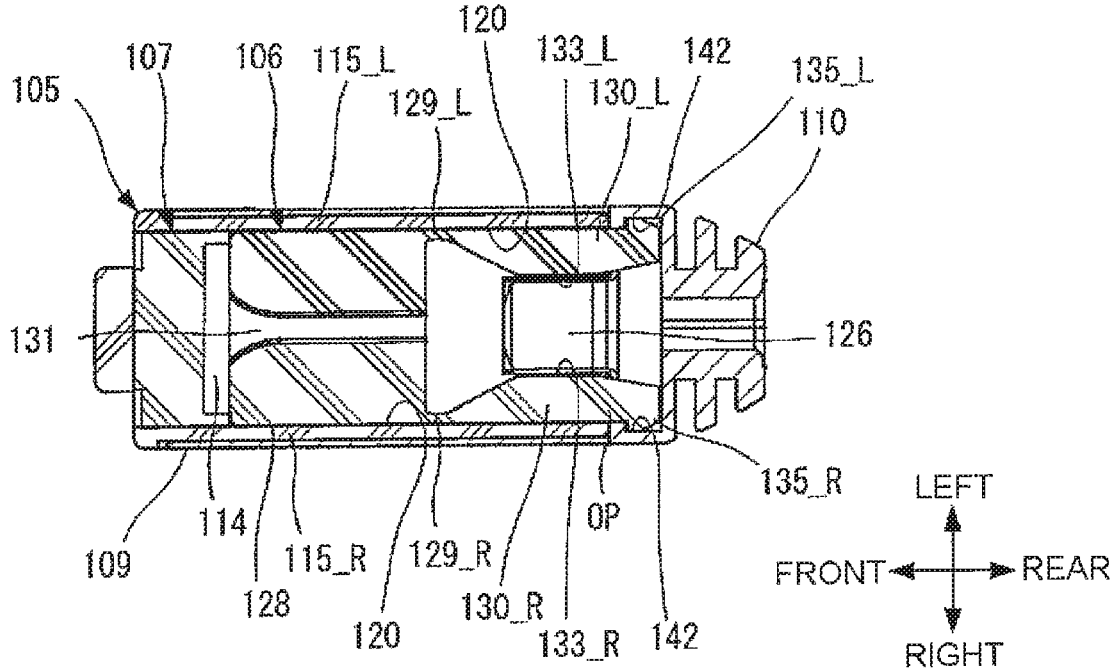
FIG. 21 is a sectional view for illustrating the connector taken along the line XXI-XXI of FIG. 7.

Here, FIG. 20 is a sectional view for illustrating the connector 100 taken along the line XX-XX of FIG. 6, as seen from the right side of the connector. FIG. 21 is a sectional view for illustrating the connector 100 taken along the line XXI-XXI of FIG. 7, as seen from a bottom side of the connector.

Specifically, the boot 110 has a substantially trapezoidal shape gradually narrowing from a front end portion to a rear end portion thereof, and has a through-hole portion 141 formed in the rear end portion and configured to allow passage of the cable 101. The front end portion of the boot 110 has a rectangular frame shape, and the boot 110 has a hollow internal space continuous with the through-hole portion 141.

The boot 110 includes four fitting portions 142 at a vicinity of the front end portion. As illustrated in FIG. 20 and FIG. 21, the four fitting portions 142 are portions to which the first boot mounting lance portions 113_L and 113_R and the second boot mounting lance portions 135_L and 135_R are fitted, respectively. Each of the four fitting portions 142 forms a hole or a protrusion to which the lance is hooked.

The configuration of the connector 100 according to this embodiment is described above. Now, a method of assembling the connector 100 is described.

(Method of Assembling Connector 100)

The method of assembling the connector 100 is carried out by assembling the components 105 to 110 forming the connector 100.

The housing 105 and the engagement member 106 in the initial state, the alignment member 107, the eight terminals 108, the conductive shell 109 including the engagement lance portions 140 extending in the downward direction, the boot 110, and the cable 101 are prepared.

Figure 22:
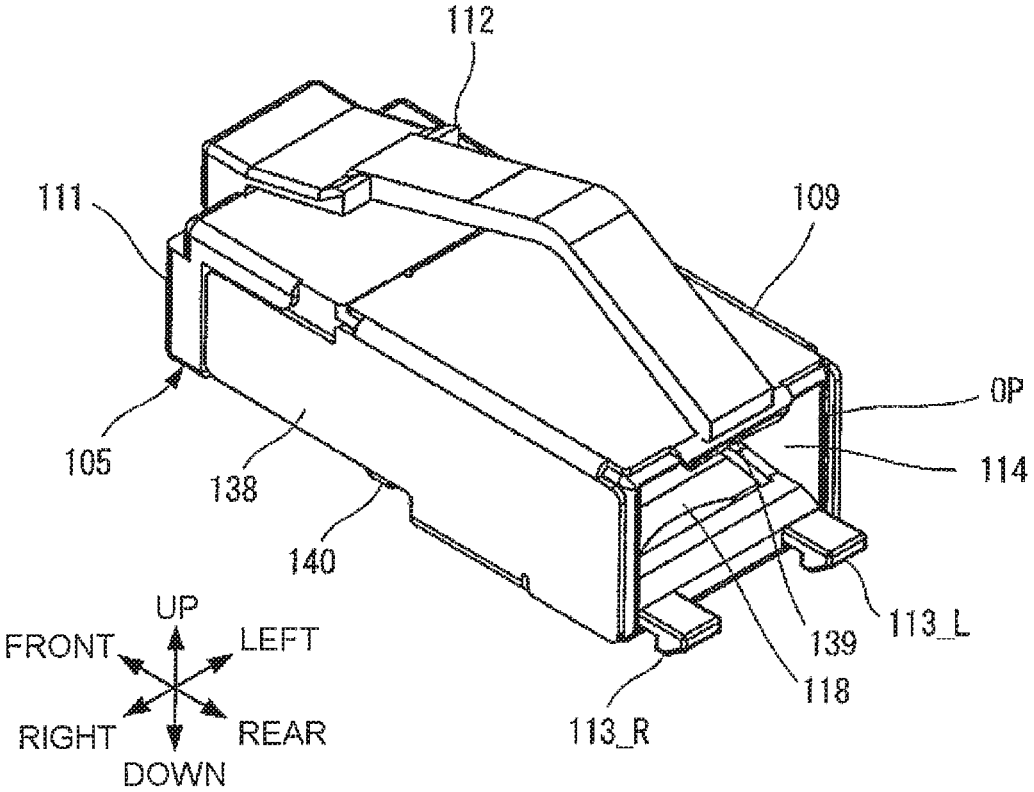
FIG. 22 is a perspective view for illustrating the housing in one embodiment of this invention under a state in which the conductive shell is mounted to the housing, as seen from an upper right rear side of the connector.

As illustrated in a perspective view of FIG. 22, the conductive shell 109 is mounted to the housing 105.

Specifically, the conductive shell 109 is mounted around the housing 105 so that positions of the engagement lance portions 140 and positions of the shell engagement groove portions 119 correspond to each other in the front-and-rear direction. The right and left engagement lance portions 140 are bent, and thus are fitted into the right and left shell engagement groove portions 119, respectively. In this manner, the conductive shell 109 is fixed to the housing 105.

Figure 23:
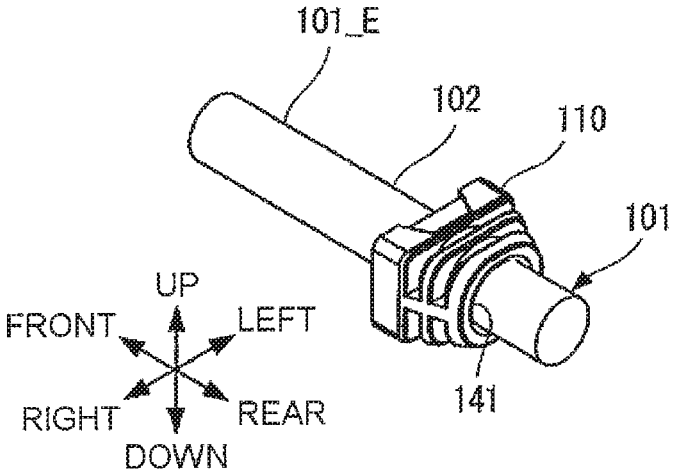
FIG. 23 is a perspective view for illustrating a state in which a boot in one embodiment is mounted to an end portion of the cable, as seen from the upper right rear side.

When the tip of the cable 101 is allowed to pass through the through-hole portion 141 from the rear side of the boot 110, as illustrated in a perspective view of FIG. 23, the boot 110 is mounted to the end portion 101_E of the cable 101.

A portion of the sheath member 102 having the length L2 from the tip of the cable 101 is peeled from the cable 101. In this manner, portions of the core wires 103 each having the length L2 are uncoated. After that, the uncoated portions of the core wires 103 are untwisted, and the conductive foil 104 is mounted to the end portion 101_E (see FIG. 3). On this occasion, the length L2 is long enough to allow the core wires 103 to pass through the engagement member 106 and the alignment member 107 and project to the front side of the alignment member 107. It is preferred that the pairs of core wires 103 be distinguished from each other by, for example, colors even after the core wires 103 are untwisted.

Figure 24:
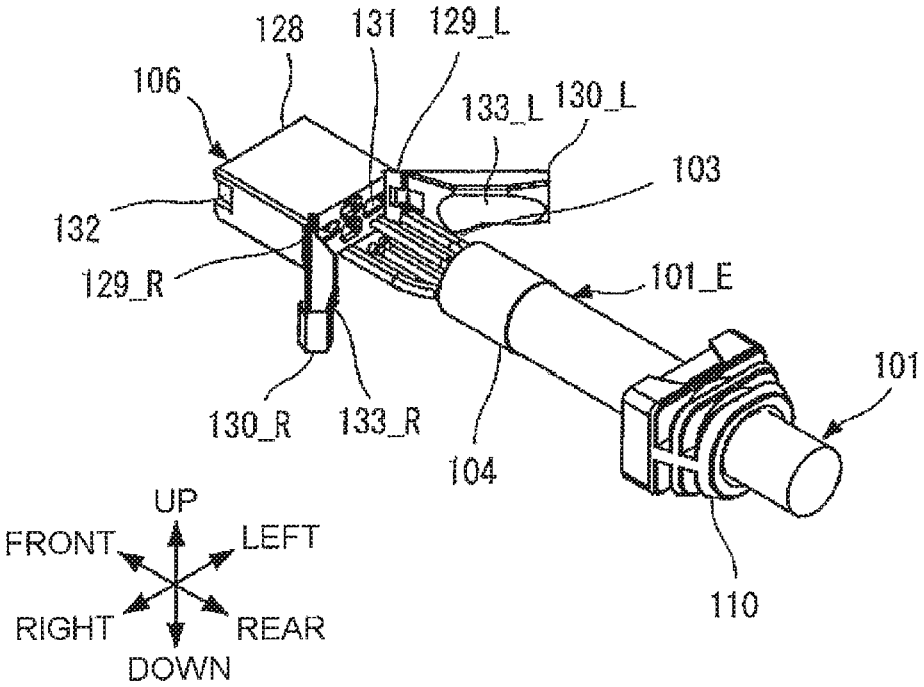
FIG. 24 is a perspective view for illustrating a state just before the end portion of the cable is mounted to the engagement member in one embodiment, as seen from the upper right rear side.
Figure 25:
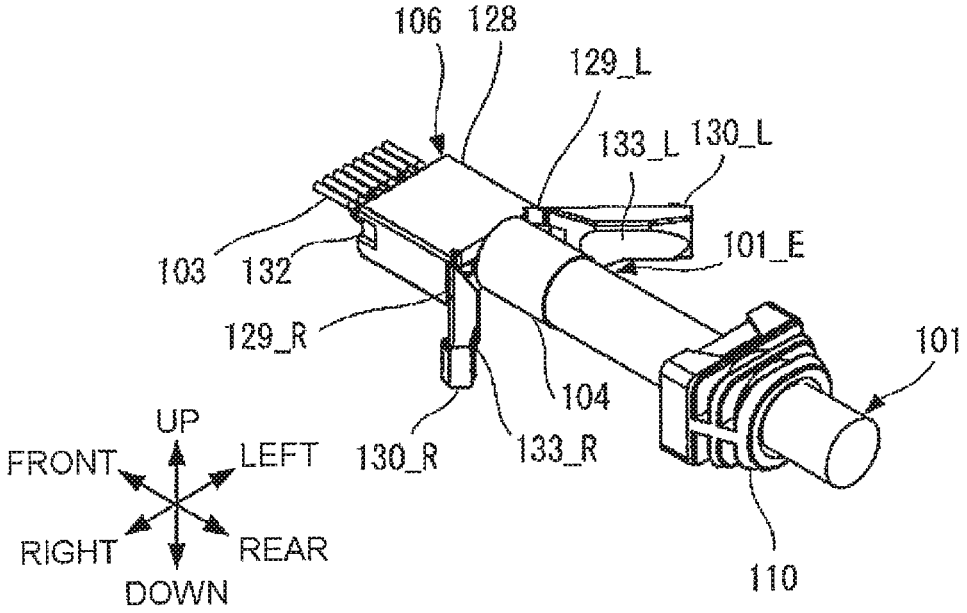
FIG. 25 is a perspective view for illustrating a state in which the end portion of the cable is mounted to the engagement member in one embodiment, as seen from the upper right rear side.

As illustrated in a perspective view of FIG. 24, the second engagement portions 130_L and 130_R are brought to the increased width position with the increased distance therebetween, and tips of the core wires 103 are positioned behind the core wire holding portion 128. Then, the core wires 103 are inserted into the dividing portions 131 from the rear side so as to pass through the dividing portions 131. In this manner, as illustrated in a perspective view of FIG. 25, the cable 101 is mounted to the engagement member 106.

On this occasion, the second engagement portions 130_L and 130_R are brought to the increased width position at the time of mounting the cable 101. In this manner, as compared to a case in which the distance between the second engagement portions 130_L and 130_R is small, the cable 101 can be easily mounted to the engagement member 106.

Further, the four pairs of core wires 103 are each divided and arranged so as to individually pass through predetermined one of the dividing portions 131 different from each other on a pairwise basis. On this occasion, it is preferred that the dividing portions 131 configured to allow passage of the core wires 103 be allocated to prevent application of loads on the core wires 103.

For example, the core wires 103_A1 and 103_A2 are arranged in the stated order from the left side so as to pass through the dividing portion 131_L in a paired manner substantially in parallel to each other. The core wires 103_B1 and 103_C2 are arranged in the stated order from the left side so as to pass through the dividing portion 131_U in a paired manner substantially in parallel to each other. The core wires 103_B2 and 103_C1 are arranged in the stated order from the left side so as to pass through the dividing portion 131_D in a paired manner substantially in parallel to each other. The core wires 103_D1 and 103_D2 are arranged in the stated order from the left side so as to pass through the dividing portion 131_R in a paired manner substantially in parallel to each other.

In order to prevent application of loads on the core wires 103, the core wires 103_B1 and 103_C2 may be arranged in the stated order from the left side so as to pass through the dividing portion 131_D in a paired manner substantially in parallel to each other. In this case, it is preferred that the core wires 103_B2 and 103_C1 be arranged in the stated order from the left side so as to pass through the dividing portion 131_U in a paired manner substantially in parallel to each other. Further, for example, the core wires 103_A1 and 103_A2, the core wires 103_B1 and 103_B2, the core wires 103_C1 and 103_C2, and the core wires 103_D1 and 103_D2 may be arranged in the dividing portions 131 in the same pairwise combinations as those inside the sheath member 102.

Figure 26:
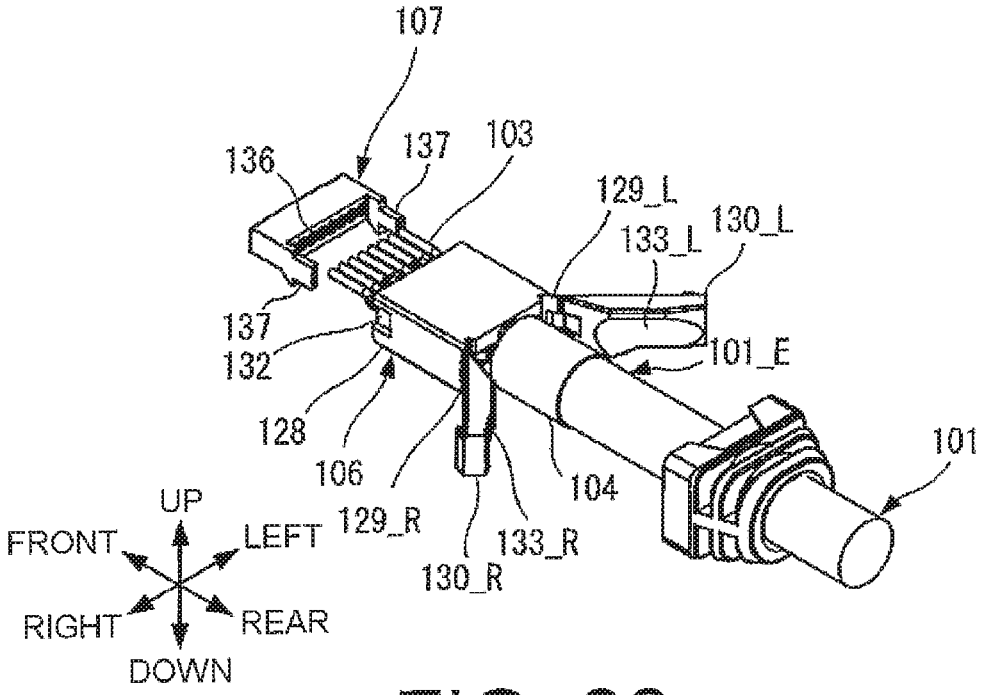
FIG. 26 is a perspective view for illustrating a state just before an alignment member is mounted to the engagement member in one embodiment, as seen from the upper right rear side.

As illustrated in a perspective view of FIG. 26, the core wires 103 having passed through the dividing portions 131 are arrayed in the predetermined order substantially in the right-and-left direction and arranged so as to extend in the forward direction. The tips of the core wires 103 are positioned behind the alignment member 107. Then, the engagement member 106 is moved in the forward direction until the right and left extending portions 137 are respectively fitted into the corresponding fitting groove portions 132 from the rear side of the alignment member 107 and the rear end portions of the extending portions 137 and the front end portions of the fitting groove portions 132 are brought into contact with each other.

Figure 27:
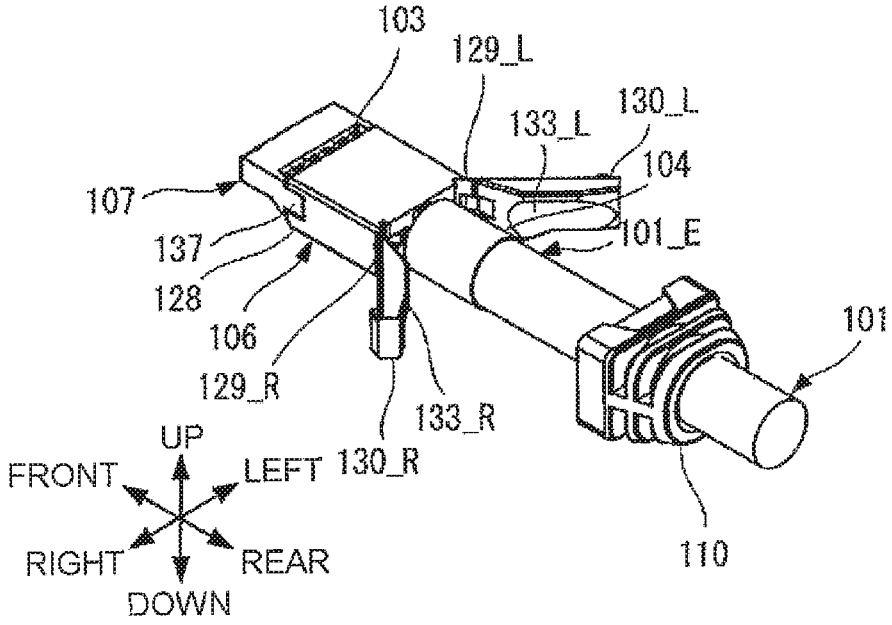
FIG. 27 is a perspective view for illustrating a state in which the alignment member is mounted to the engagement member in one embodiment, as seen from the upper right rear side.

On this occasion, the eight core wires 103 extending from the engagement member 106 in the forward direction pass through the corresponding eight alignment hole portions 136, respectively. For example, the core wires 103_A1, 103_A2, 103_B1, 103_B2, 103_C1, 103_C2, 103_D1, and 103_D2 are arrayed in the stated order from the left side, and pass through the alignment hole portions 136_1 to 8, respectively. In this manner, as illustrated in a perspective view of FIG. 27, the alignment member 107 is positioned in front of the engagement member 106, and is mounted to the engagement member 106.

Portions of the core wires 103 projecting forward from the alignment member 107 are cut so that the core wires 103 are flush with a front surface of the alignment member 107.

Figure 28:
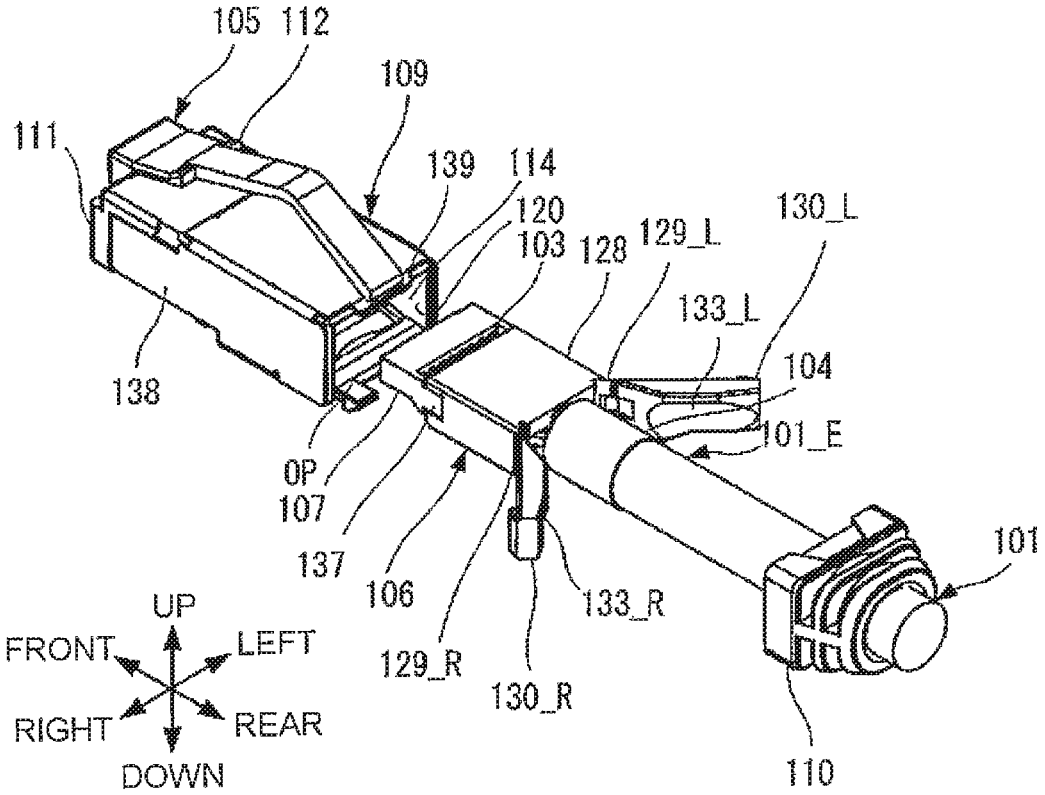
FIG. 28 is a perspective view for illustrating a state just before the engagement member and the alignment member, together with the cable, are mounted to the housing in one embodiment, as seen from the upper right rear side.
Figure 29:
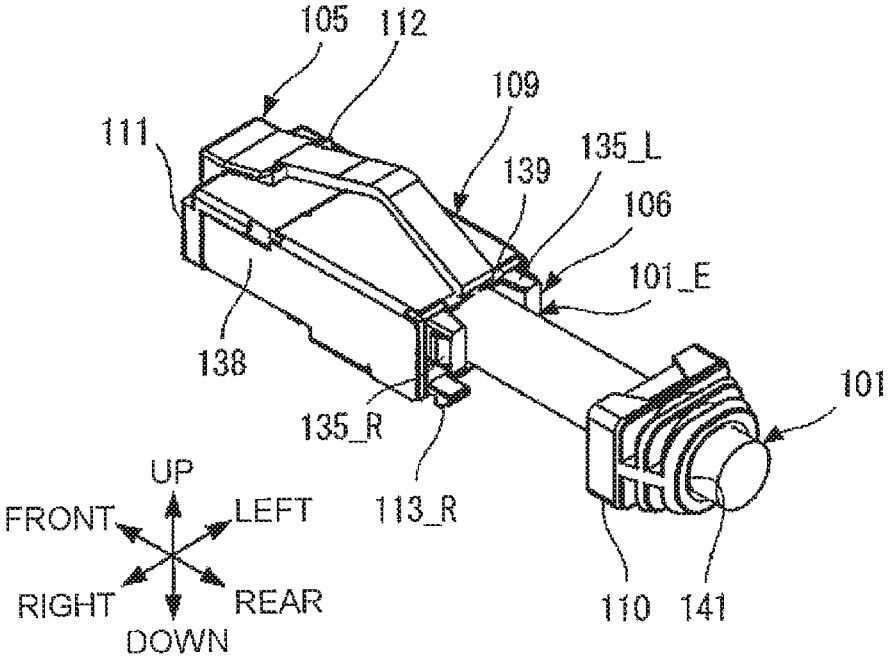
FIG. 29 is a perspective view for illustrating a state in which the engagement member and the alignment member, together with the cable, are mounted to the housing in one embodiment and arranged in an arrangement space of the housing and is an illustration of a state just before the boot is mounted to the housing, as seen from the upper right rear side.

Then, as illustrated in a perspective view of FIG. 28, the engagement member 106, together with the alignment member 107, is positioned behind the housing 105. Then, as illustrated in a perspective view of FIG. 29, the alignment member 107 and the engagement member 106 are moved toward the housing 105 in the forward direction until the alignment member 107 and the engagement member 106 are brought into contact with the arrangement surface section 120 located on the front side of the alignment member 107 through the opening OP. In this manner, as illustrated in FIG. 29, the alignment member 107 and the engagement member 106 are arranged in the arrangement space 114 together with the end portion 101_E of the cable 101.

Specifically, under a state in which the second engagement portions 130_L and 130_R are brought to the increased width position (see FIG. 28), the alignment member 107 and the engagement member 106 having the end portion 101_E mounted thereto are pushed into the housing 105 from the rear side of the housing 105 in the forward direction through the opening OP along the arrangement surface section 120.

When the second engagement portions 130_L and 130_R are moved in the forward direction toward the housing 105 through the opening OP, the outer surfaces of the second engagement portions 130_L and 130_R are brought into contact with the rear end of the arrangement surface section 120 of the housing, and are moved while gradually decreasing the distance in the right-and-left direction. The rear end of the arrangement surface section 120 is a portion forming the opening OP. In this manner, the second engagement portions 130_L and 130_R are displaced so as to gradually decrease the distance between the pressing surface portions 133_L and 133_R.

Then, when the engagement member 106 is pushed into the housing 105 until the front end of the alignment member 107 is brought into contact with the arrangement surface section 120 located on the front side of the alignment member 107, the conductive foil 104 is positioned below the shell extending portion 139, and the second engagement portions 130_L and 130_R are brought to the engagement position.

Figure 30:
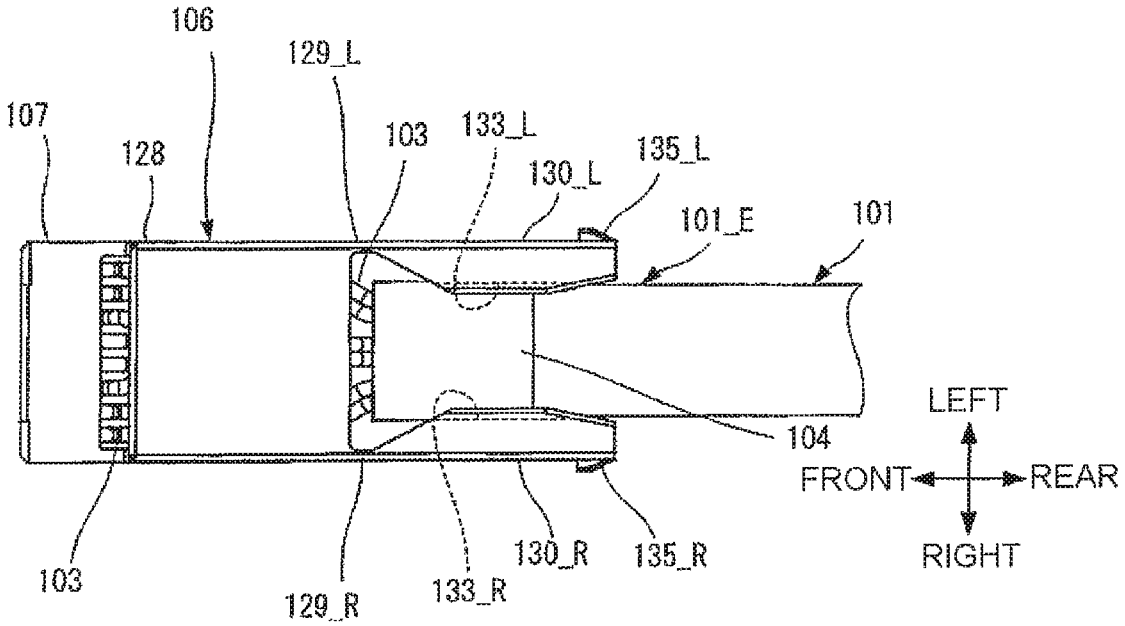
FIG. 30 is a plan view for illustrating the engagement member and the alignment member under a state in which the cable in one embodiment is mounted, and is an illustration of a state in which the engagement member and the alignment member, together with the end portion of the cable, are arranged in the arrangement space of the housing.

The second engagement portions 130_L and 130_R brought to the engagement position extend in the front-and-rear direction substantially in parallel to each other under a state in which the right and left outer surfaces of the second engagement portions 130_L and 130_R are held in contact with the arrangement surface section 120. Then, as illustrated in FIG. 30, the second engagement portions 130_L and 130_R sandwich the cable 101 from the right and left sides of the cable 101 by the pressing surface portions 133_L and 133_R, and press the outer surface of the cable 101. In this manner, the engagement member locks the cable 101 in the arrangement space 114.

Here, FIG. 30 is a plan view for illustrating a state in which the second engagement portions 130_L and 130_R brought to the engagement position sandwich the cable 101 in the arrangement space 114.

On this occasion, as described above, the alignment hole portions 136 define spaces communicating with the terminal receiving portions 116 respectively corresponding to the alignment hole portions 136. Therefore, contact with the core wires 103, which are respectively arranged in the alignment hole portions 136, is allowed from the outside of the housing 105 and the lower side of the housing 105 through the terminal spaces.

Figure 31:
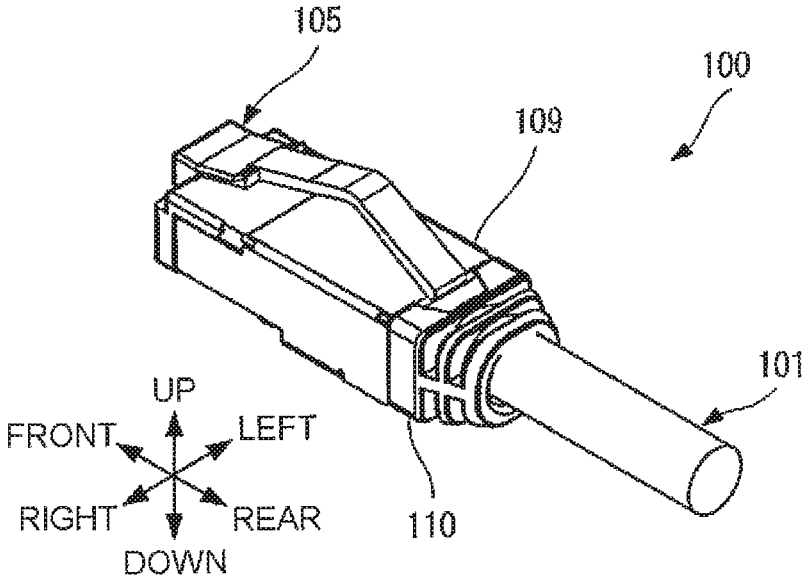
FIG. 31 is a perspective view for illustrating a state in which the boot in one embodiment is mounted to the housing and the engagement member, as seen from the upper right rear side.

As illustrated in a perspective view of FIG. 31, the boot 110 is mounted to the housing 105 and the engagement member 106.

Specifically, the boot 110 is moved in the forward direction along the cable 101 from the rear side of the housing 105 and the engagement member 106. Then, the boot 110 is pushed into the housing 105 and the engagement member 106 so that the first boot mounting lance portions 113_L and 113_R and the second boot mounting lance portions 135_L and 135_R are fitted to the corresponding fitting portions 142, respectively. In this manner, the boot 110 is locked to the housing 105 and the engagement member 106 so as to be prevented from easily slipping out of the housing 105 and the engagement member 106.

Figure 32:
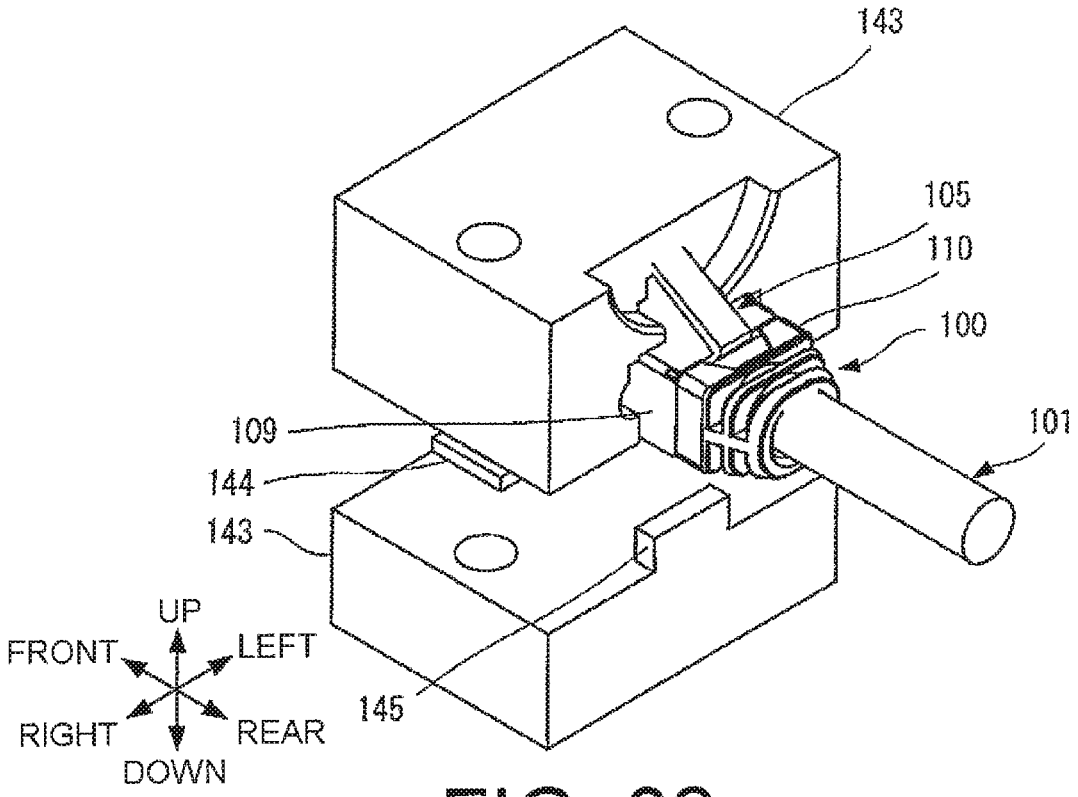
FIG. 32 is a perspective view for illustrating a pressure-joining tool in one embodiment just before terminals are mounted and the first engagement portion is displaced to a holding position, as seen from the upper right rear side.
Figure 33:
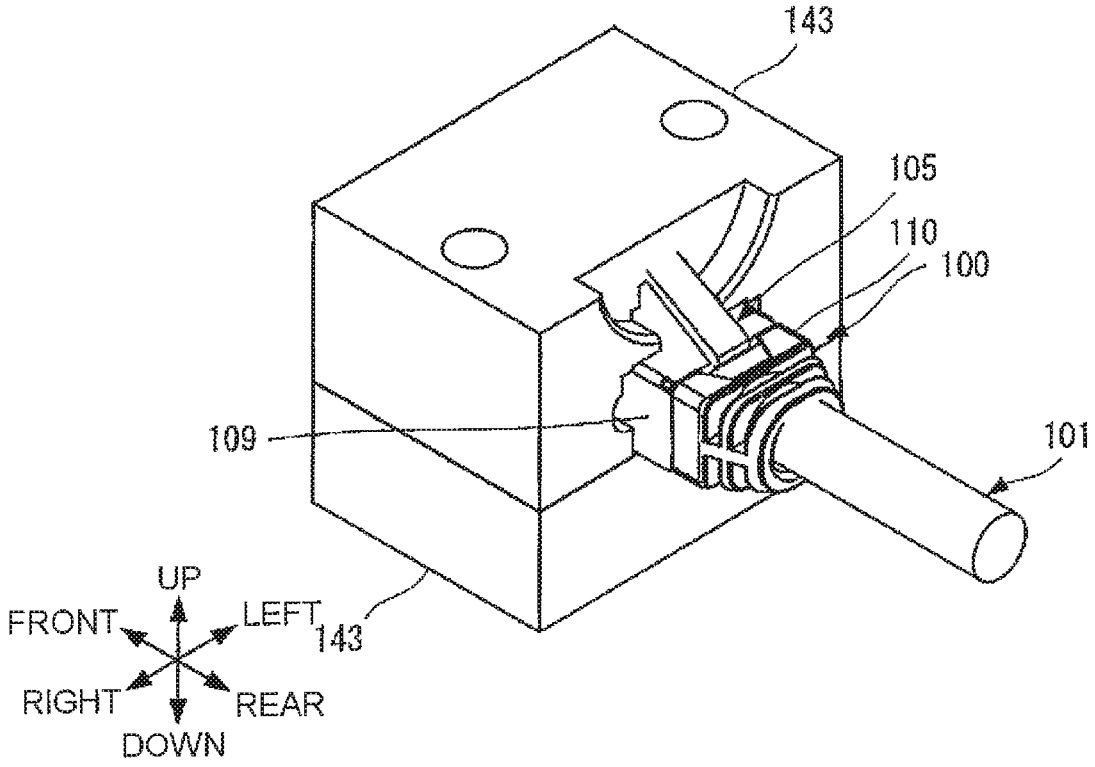
FIG. 33 is a perspective view for illustrating the pressure-joining tool in one embodiment when the terminals are mounted and the first engagement portion is brought to the holding position.

Through use of a pressure-joining tool 143 as illustrated in perspective views of FIG. 32 and FIG. 33, the eight terminals 108 are mounted, and the first engagement portion 118 is brought to the holding position. FIG. 32 is a perspective view for illustrating the pressure-joining tool just before the terminals 108 are mounted and the first engagement portion 118 is displaced to the holding position. FIG. 33 is a perspective view for illustrating the pressure-joining tool when the terminals 108 are mounted and the first engagement portion 118 is brought to the holding position.

The pressure-joining tool 143 is a tool configured to mount the terminals 108 and displace the first engagement portion 118 from the initial position to the holding position. The pressure-joining tool 143 includes two members arranged substantially in the up-and-down direction. The upper member of the pressure-joining tool 143 is configured to hold the housing 105, in which the cable 101 is arranged in the arrangement space 114, and the conductive shell 109 in addition to the alignment member 107 and the engagement member 106.

The lower member of the pressure-joining tool 143 includes a holding portion 144 formed at a vicinity of a front portion of the lower member, and a pressing protrusion 145 formed at a vicinity of a rear end thereof. The holding portion 144 is configured to hold the eight terminals 108 with a relatively small force under a state in which the eight terminals 108 are arrayed at predetermined intervals in the right-and-left direction. The pressing protrusion 145 has a substantially rectangular parallelepiped shape, and projects in the upward direction.

The upper and lower members of the pressure-joining tool 143 are pushed against each other so that the eight terminals 108 are inserted into vicinities of the tips of the core wires 103 in the terminal spaces of the terminal receiving portions 116 corresponding to the terminals 108, respectively. In this manner, the terminals 108 are caused to penetrate through insulating members sheathing the core wires 103 to come into contact with the inside electric wires, and thus are fixed to the core wires 103. As a result, the terminals 108 are electrically connected to the corresponding core wires 103, and are fixed in a state of being received in the terminal receiving portions 116.

Figure 34:
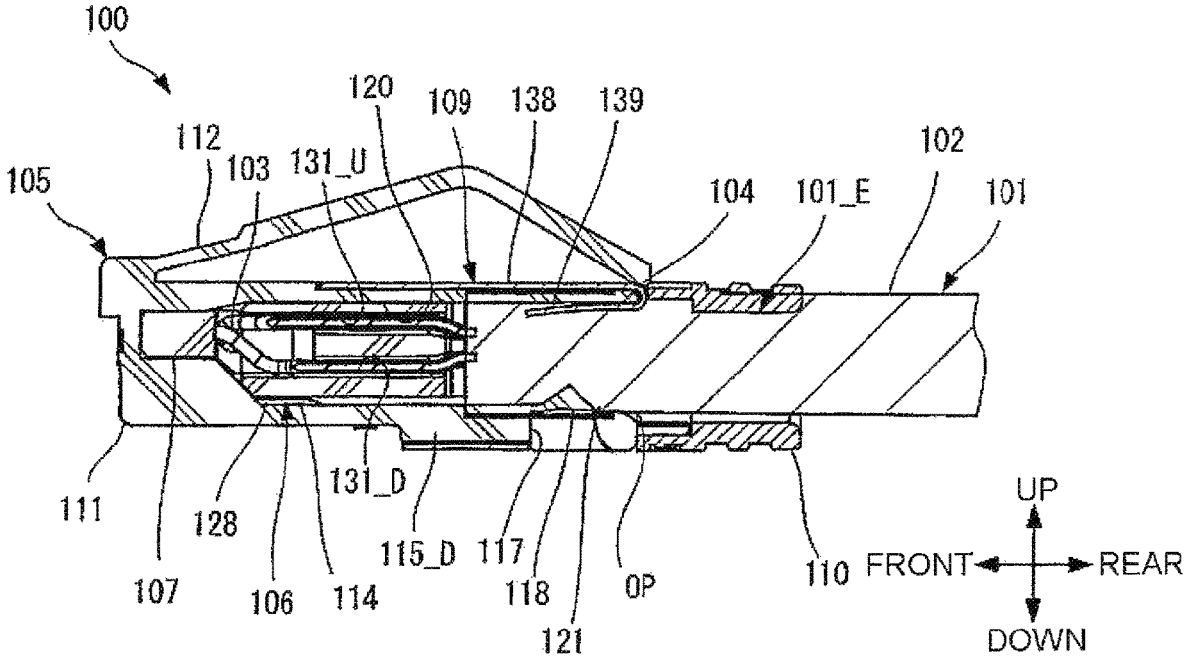
FIG. 34 is a sectional view corresponding to FIG. 7, and is an illustration of the connector in a holding state.
Figure 35:
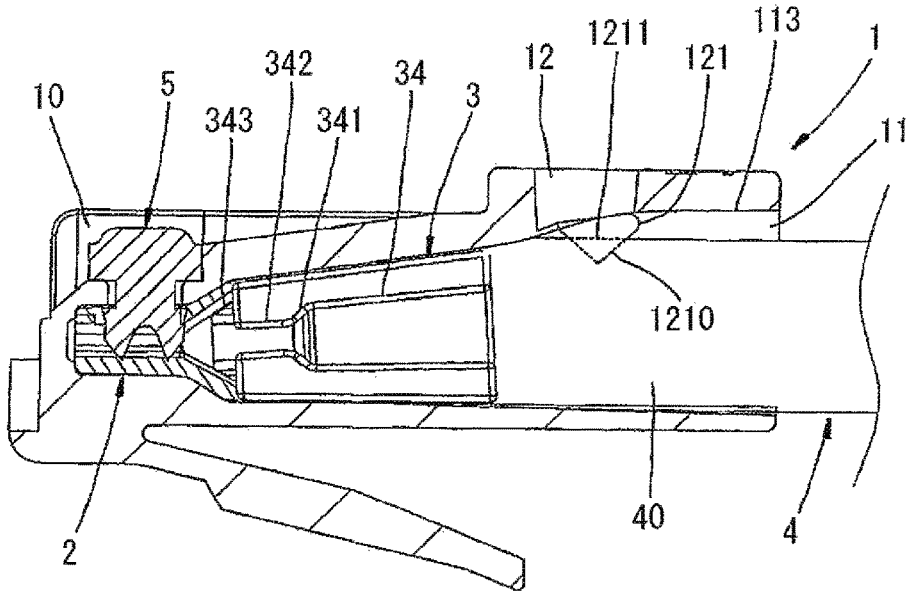
FIG. 35 Related Art
FIG. 35 is a view for illustrating a high-frequency transmission plug in the related art.

Further, the upper and lower members of the pressure-joining tool 143 are pushed against each other so that the pressing protrusion 145 pushes the first engagement portion 118 in the upward direction. In this manner, as illustrated in FIG. 34 being a side sectional view, the first projecting portion 123 passes the front of the return preventing portion 121, and is brought to the holding position above the return preventing portion 121.

When the first engagement portion 118 is at the holding position, all the second projecting portion 124, the cable engagement portion 126, and the restricting portions 127_L and 127_R are positioned so as to project into the arrangement space 114. A surface formed by the cable engagement portion 126 and the restricting portions 127_L and 127_R is directed upward and forward. The cable engagement portion 126 presses the outer surface of the cable 101 together with the second projecting portion 124.

The first engagement portion 118 at the holding position locks the end portion 101_E of the cable 101 by sandwiching the cable 101 from the upper and lower sides of the cable 101 by the second projecting portion 124 and the cable engagement portion 126 together with the shell extending portion 139. At the same time, the outer surface of the end portion 101_E of the cable 101 is pressed and locked not only by the first engagement portion 118 and the shell extending portion 139 but also by the pair of second engagement portions 130_L and 130_R as described above. In this manner, the end portion 101_E of the cable 101 is brought into a holding state of being firmly fixed in the arrangement space 114.

Under the holding state in this embodiment, the shell extending portion 139 and the conductive foil 104 are held in contact with each other to be electrically connected to each other. Further, the restricting portions 127_L and 127_R are arranged so as to be opposed to the restricted portions 134_L and 134_R substantially in the front-and-rear direction, thereby restricting rearward movement of the engagement member 106 with respect to the housing 105.

The downward movement of the first engagement portion 118 is restrained by the return preventing portion 121, and hence the engagement member 106 is kept in the holding state. Thus, the connector 100 is completed under a state in which the cable 101 is connected to the connector 100.

One embodiment of this invention is described above. According to this embodiment, the following operations and effects are attained.

(Operations and Effects)

According to this embodiment, the connector 100 includes the housing 105 including the first engagement portion 118, and the engagement member 106 including the pair of second engagement portions 130_L and 130_R. The housing 105 includes the arrangement surface section 120 defining the arrangement space 114 extending from the inside of the housing 105 toward the opening OP formed on the rear side of the housing 105, and the engagement member 106 is arranged in the arrangement space 114. The first engagement portion 118 is configured to lock the cable 101 by pressing the outer surface of the cable 101 in the upward direction. The pair of second engagement portions 130_L and 130_R is configured to lock the cable 101 by pressing the outer surface of the cable 101 in the right-and-left direction through contact with the arrangement surface section 120.

As described above, the outer surface of the cable 101 is pressed and locked from different directions, thereby being capable of dispersing a pressing force for engagement the cable 101. Accordingly, even when the pressing force applied from each direction is reduced as compared to a pressing force applied, for example, in a case of pressing only by the first engagement portion 118 in order to fix the cable 101 in the arrangement space 114, the cable 101 can be firmly fixed. Therefore, the cable can be firmly fixed while reducing a risk of damaging the cable.

According to this embodiment, the engagement member 106 includes the core wire holding portion 128 configured to hold the eight core wires 103. The pair of second engagement portions 130_L and 130_R extends in the rearward direction from the rear end portion of the core wire holding portion 128 through intermediation of the coupling portions 129_L and 129_R.

As described above, the pair of second engagement portions 130_L and 130_R is provided so as to extend in the rearward direction from the rear end portion of the core wire holding portion 128. With this configuration, the pair of second engagement portions 130_L and 130_R and the core wire holding portion 128 are indirectly connected, thereby being capable of reducing the number of components forming the connector 100. Therefore, the connector 100 can be easily assembled.

According to this embodiment, the engagement member 106 further includes coupling portions 129_L and 129_R configured to couple the core wire holding portion 128 and each of the pair of second engagement portions 130_L and 130_R to each other. Each of the pair of second engagement portions 130_L and 130_R is rotated about the coupling portions 129_L and 129_R with respect to the core wire holding portion 128.

Thus, the pair of second engagement portions 130_L and 130_R, which connects to the core wire holding portion 128 and is displaced between the increased width position and the engagement position, can be provided with a simple configuration. Therefore, with the simple configuration, the cable can be firmly fixed while reducing the risk of damaging the cable.

According to this embodiment, the coupling portions 129_L and 129_R are formed integrally with the core wire holding portion 128 and the pair of second engagement portions 130_L and 130_R. Thus, the pair of second engagement portions 130_L and 130_R, which connects to the core wire holding portion 128 and is displaced between the increased width position and the engagement position, can be provided with a simpler configuration. Therefore, with the simpler configuration, the cable can be firmly fixed while reducing the risk of damaging the cable.

According to this embodiment, when the pair of second engagement portions 130_L and 130_R is moved through the opening to the front side of the housing 105 so as to be arranged in the arrangement space 114, the outer surfaces of the pair of second engagement portions 130_L and 130_R are brought into contact with the arrangement surface section 120. With this configuration, the distance between the pressing surface portions 133_L and 133_R is gradually decreased. With such distance between the outer surfaces, the second engagement portions 130_L and 130_R connect to a rear end portion of the core wire holding portion 128 through intermediation of the coupling portions 129_L and 129_R.

With this configuration, when the cable 101 is mounted to the engagement member 106, the second engagement portions 130_L and 130_R can be brought to the increased width position at which the distance between the second engagement portions 130_L and 130_R is larger than the thickness of the cable 101. Thus, the cable 101 can be easily mounted to the engagement member 106. Further, the cable 101 can be locked to the second engagement portions 130_L and 130_R by only moving the engagement member 106 through the opening OP to the front side of the housing 105. Therefore, the connector 100 can be easily assembled.

According to this embodiment, the core wire holding portion 128 is configured to hold the eight core wires 103 while dividing the core wires 103 into groups. With this configuration, the core wires 103 can be arranged while preventing application of loads on the core wires 103 inside the connector 100. Therefore, the cable can be firmly fixed while further reducing the risk of damaging the cable.

According to this embodiment, inside the sheath member 102, the eight core wires 103 include four pairs, that is, the pair of core wires 103_A1 and 103_A2, the pair of core wires 103_B1 and 103_B2, the pair of core wires 103_C1 and 103_C2, and the pair of core wires 103_D1 and 103_D2. The core wire holding portion 128 includes the four dividing portions 131 configured to arrange the core wires 103 in the front-and-rear direction while dividing the core wires 103 into groups having combinations different from those of the pairs of the core wires 103 inside the sheath member 102.

With this configuration, the core wires 103 can be arranged while preventing further application of loads on the core wires 103 inside the connector 100. Therefore, the cable can be firmly fixed while further reducing the risk of damaging the cable.

Each of the dividing portions 131 forms a through-hole configured to allow passage of the pair of the core wires 103 in the front-and-rear direction. With this configuration, each of the dividing portions 131 surrounds (the upper, lower, right, and left sides of) the core wires 103 arranged in a paired manner. Accordingly, unlike a case in which the dividing portions each form, for example, a groove extending in the front-and-rear direction, the pair of core wires 103 can be reliably arranged and kept in each of the dividing portions 131. Therefore, in a course of assembly such as during arrangement of the engagement member 106 in the arrangement space 114, the core wires 103 do not stick out of the dividing portions 131. Thus, the connector 100 can be easily assembled.

According to this embodiment, the connector 100 further includes the alignment member 107 configured to align the core wires 103 in the front-and-rear direction. The alignment member 107 is arranged in the arrangement space 114 so as to be opposed to the front end portion of the core wire holding portion 128. With this configuration, while the core wires 103 are aligned in the right-and-left direction, one ends of the core wires 103 can be positioned on the front side of the connector 100. The core wires 103 can be arranged on the front side of the connector 100 in accordance with an array of terminals of the mating connector. Thus, the core wires 103 can be reliably and easily connected to, for example, the wires connected to the mating connector 100.

According to this embodiment, the first engagement portion 118 includes restricting portions 127_L and 127_R configured to restrict movement of the engagement member 106 in the rearward direction with respect to the housing 105 through contact with the second engagement portions 130_L and 130_R under a state in which the first engagement portion 118 locks the cable 101 (holding state). The first engagement portion 118 includes the restricting portions 127_L and 127_R. Thus, with the simple configuration, the engagement member 106 can be prevented from slipping out of the housing 105. Therefore, with this simple configuration, the cable can be firmly fixed while reducing the risk of damaging the cable.

According to this embodiment, the pair of second engagement portions 130_L and 130_R includes pressing surface portions 133_L and 133_R forming a curved surface configured to press the outer surface of the cable 101. Each of the pressing surface portions 133_L and 133_R may be a flat surface, and may be configured to press the outer surface of the cable 101 by a curved surface or a flat surface rather than a linear portion. Accordingly, load concentration on a part of the outer surface of the cable 101 can be prevented. Therefore, the cable can be firmly fixed while further reducing the risk of damaging the cable.

According to this embodiment, the second projecting portion 124 and the shell extending portion 139 are curved as described in the embodiment. Accordingly, load concentration on a part of the outer surface of the cable 101 can be prevented. Therefore, the cable can be firmly fixed while further reducing the risk of damaging the cable.

According to this embodiment, the connector 100 further includes the conductive shell 109. The conductive shell 109 includes the shell body portion 138 to be arranged around the housing 105, and the shell extending portion 139. The shell extending portion 139 extends from the shell body portion 138 toward the arrangement space 114, and is arranged to be opposed to the first engagement portion 118. The shell extending portion 139 is configured to press the outer peripheral surface of the cable 101 arranged in the arrangement space 114.

With this configuration, the shell extending portion 139 can press the outer surface of the cable 101. In addition, the conductive foil 104 formed on the outer surface of the cable 101 can be electrically connected to the shell extending portion 139. For example, when the conductive shell 109 is connected to reference potential, the conductive foil 104 can function as an electromagnetic shielding. Therefore, the connector 100 having high noise resistance can be provided.

According to this embodiment, each of the eight core wires 103 is formed of a coated electric wire. In general, when the core wires 103 are damaged in a case in which the core wires 103 are electric wires, a transmission characteristic is sometimes degraded due to, for example, increase in cross talk or return loss. As described above, the connector 100 according to this embodiment can reduce the risk of damaging the cable, thereby being capable of suppressing degradation of the transmission characteristic.

The connector 100 further includes the eight terminals 108 respectively mounted to the eight core wires 103 and arranged in the housing 105. With this configuration, the core wires 103 can be connected to, for example, the wires of the mating connector through the terminals 108. Therefore, the core wires 103 can be reliably, easily, and electrically connected to, for example, the wires of the mating connector.

In the above, one embodiment of this invention has been described. However, this invention is not limited to the embodiment described above, and may be modified as follows.

Modification Example

It is only required that the pair of second engagement portions be arranged in an opposing manner in the right-and-left direction through contact with the arrangement surface section 120 when the pair of second engagement portions is arranged in the arrangement space 114, and be configured to lock the cable 101 by pressing and sandwiching the outer surface of the cable 101. Such second engagement portions may each be formed of, for example, an individual member separated from the core wire holding portion.

Further, for example, the coupling portions may each be made of, for example, metal or a resin, and be formed of a shaft member such as a pin arranged substantially along the up-and-down direction. Each of the second engagement portions may connect to the rear surface portion of the core wire holding portion 128 through intermediation of the coupling portion being the shaft member, and may be rotated about the coupling portion with respect to the core wire holding portion.

Moreover, for example, the pair of second engagement portions may directly connect to the rear surface portion of the core wire holding portion without intermediation of the coupling portions. In this case, for example, it is preferred that the pair of second engagement portions in the initial state have a distance larger than the width of the arrangement surface section 120, and that the pair of second engagement portions in the engagement state be elastically deformed so as to have the distance substantially equal to the width of the arrangement surface section 120, thereby being capable of engagement the cable 101. It is preferred that, similarly to the embodiment, also the pair of second engagement portions described above connect to the rear end portion of the core wire holding portion so as to have the distance allowing the outer surfaces of the pair of second engagement portions to come into contact with the arrangement surface section 120 when the pair of second engagement portions is moved through the opening OP to the front side of the housing so as to be arranged in the arrangement space 114. It is preferred that the pair of second engagement portions connect to the rear end portion of the core wire holding portion so that a distance between inner surfaces of the pair of second engagement portions opposed to each other in the right-and-left direction is gradually decreased through contact with the arrangement surface section 120 accompanied with the movement.

In the above, the embodiment and the modification examples of this invention are described. However, this invention is not limited to the embodiment and modification examples described above. For example, this invention may include a mode in which the embodiment and the modification examples described above are partially or entirely combined in a suitable manner or a mode suitably changed from the mode of combination.

What is claimed is:

1. A connector to which an end portion of a cable including a plurality of core wires is to be connected, the connector comprising:

a housing including an arrangement surface section which is inner surfaces of all walls around an arrangement space in which the cable is arranged through an opening, the arrangement space extending in a first direction from an inside of the housing toward the opening; and an engagement member, which is arranged in the arrangement space, and is configured to hold the cable in the arrangement space together with the housing, wherein the housing includes a first engagement portion configured to lock the cable in such a manner that the first engagement portion is displaced in a second direction orthogonal to the first direction so as to project into the arrangement space, and thus presses an outer surface of the cable arranged in the arrangement space, and wherein the engagement member includes a pair of second engagement portions arranged in an opposing manner along a third direction, which is orthogonal to the first direction and intersects the second direction upon encroachment with the arrangement surface section when the engagement member is inserted into the arrangement space, and the pair of second engagement portions is configured to lock the cable by pressing against and sandwiching the outer surface of the cable inserted between the opposing second engagement portions.

2. The connector according to claim 1, wherein the engagement member further includes a core wire holding portion configured to hold the plurality of core wires, and wherein each of the pair of second engagement portions extends in the first direction from one of end portions of the core wire holding portion along the first direction.

3. The connector according to claim 2, wherein the engagement member further includes coupling portions configured to couple the core wire holding portion and each of the pair of second engagement portions to each other, and wherein each of the pair of second engagement portions is rotated about the coupling portion with respect to the core wire holding portion.

4. The connector according to claim 3, wherein the coupling portion is formed integrally with the core wire holding portion and each of the pair of second engagement portions.

5. The connector according to claim 3, wherein, when the pair of second engagement portions is moved through the opening into the housing in a direction opposite to the first direction so as to be arranged in the arrangement space, outer surfaces of the pair of second engagement portions are brought into contact with the arrangement surface section so that a distance between inner surfaces of the pair of second engagement portions opposed to each other along the third direction is gradually decreased, and the pair of second engagement portions connects to the one of end portions of the core wire holding portion through intermediation of the coupling portions.

6. The connector according to claim 2, wherein the core wire holding portion is configured to hold the plurality of core wires while dividing the plurality of core wires into groups each including at least one core wire.

7. The connector according to claim 6, wherein the plurality of core wires comprise a plurality of pairs of core wires, and wherein the core wire holding portion includes a plurality of dividing portions configured to arrange the core wires along the first direction while dividing the core wires into the groups on a pairwise basis.

8. The connector according to claim 7, wherein each of the dividing portions forms a through-hole that extends along the first direction and is configured to allow passage of the pair of the core wires.

9. The connector according to claim 2, further comprising an alignment member configured to align the core wires along the first direction, and arranged in the arrangement space so as to be opposed to another of the end portions of the core wire holding portion along the first direction.

10. The connector according to claim 1, wherein the first engagement portion includes a restricting portion configured to restrict movement of the engagement member in the first direction with respect to the housing through contact with at least one of the pair of second engagement portions under a state in which the first engagement portion locks the cable.

11. The connector according to claim 1, wherein each of the pair of second engagement portions includes a pressing surface portion forming one of a flat surface and a curved surface configured to press the outer surface of the cable.

12. The connector according to claim 1, further comprising a conductive shell including:

a shell body portion to be arranged around the housing; and a shell extending portion extending from the shell body portion toward the arrangement space, the shell extending portion being arranged to be opposed to the first engagement portion and configured to press an outer peripheral surface of the cable arranged in the arrangement space.

13. The connector according to claim 1, wherein each of the plurality of core wires is formed of a coated electric wire, and wherein the connector further comprises a plurality of terminals respectively mounted to the plurality of core wires and arranged in the housing.

* * * * *